US008077103B1

(12) United States Patent
Acosta et al.

(10) Patent No.: US 8,077,103 B1
(45) Date of Patent: Dec. 13, 2011

(54) CUP WAVEGUIDE ANTENNA WITH INTEGRATED POLARIZER AND OMT

(75) Inventors: Roberto J. Acosta, North Olmsted, OH (US); Carol Kory, Westlake, OH (US); Kevin M. Lambert, North Royalton, OH (US)

(73) Assignee: The United States of America as represented by the Administrator of the National Aeronautics and Space Administration, Washington, DC (US)

( * ) Notice: Subject to any disclaimer, the term of this patent is extended or adjusted under 35 U.S.C. 154(b) by 1161 days.

(21) Appl. No.: 11/774,574

(22) Filed: Jul. 7, 2007

(51) Int. Cl.
*H01Q 19/00* (2006.01)

(52) U.S. Cl. ..... 343/756; 343/786; 333/21 A

(58) Field of Classification Search ..... 343/756, 343/772, 773, 775, 786; 333/21 A, 248
See application file for complete search history.

(56) References Cited

U.S. PATENT DOCUMENTS

| | | | | |
|---|---|---|---|---|
| 3,438,043 | A | 4/1969 | Ehrenspeck | |
| 3,508,278 | A | 4/1970 | Ehrenspeck | |
| 3,731,236 | A | 5/1973 | Di Tullio et al. | |
| 4,005,433 | A | 1/1977 | Tsuda | |
| 4,126,835 | A | 11/1978 | Gould | |
| 4,183,027 | A | 1/1980 | Ehrenspeck | |
| 4,240,080 | A | 12/1980 | Woodward | |
| 4,673,945 | A | 6/1987 | Syrigos | |
| 4,897,664 | A | 1/1990 | Killackey et al. | |
| 5,212,461 | A * | 5/1993 | Aicardi et al. | 333/125 |
| 5,243,357 | A * | 9/1993 | Koike et al. | 343/776 |
| 5,461,394 | A | 10/1995 | Weber | |
| 5,576,668 | A * | 11/1996 | Clark et al. | 333/21 A |
| 5,619,216 | A | 4/1997 | Park | |
| 5,973,652 | A | 10/1999 | Sanford et al. | |
| 6,087,908 | A | 7/2000 | Haller et al. | |
| 6,130,649 | A | 10/2000 | Wojtkowiak et al. | |
| 6,384,796 | B1 | 5/2002 | Reimann et al. | |
| 6,452,561 | B1 | 9/2002 | West et al. | |
| 6,507,323 | B1 | 1/2003 | West | |
| 6,603,438 | B2 | 8/2003 | Strickland | |
| 6,661,309 | B2 | 12/2003 | Chen et al. | |
| 6,727,845 | B2 | 4/2004 | Burger | |
| 6,987,360 | B1 | 1/2006 | Caplan et al. | |
| 7,002,528 | B2 * | 2/2006 | Moheb | 343/781 R |
| 7,068,129 | B2 | 6/2006 | Higgins et al. | |

(Continued)

OTHER PUBLICATIONS

Ahmed, Z. A., Physics: Short Backfire Antenna With Conical Back Reflector and Double Small Front Reflectors pp. 49-52, Journal of Islamic Academy of Sciences 0:2, 49-52, 1996, http://www.medicaljournal-ias.org/9_2/Ahmed.pdf.

(Continued)

*Primary Examiner* — Dieu H Duong
(74) *Attorney, Agent, or Firm* — Robert H. Earp, III; Woodling, Krost & Rust

(57) ABSTRACT

A cup waveguide antenna with integrated polarizer and OMT for simultaneously communicating left and right hand circularly polarized electromagnetic waves is adjustable to obtain efficient propagation and reception of electromagnetic waves. The antenna includes a circular waveguide having an orthomode transducer utilizing first and second pins longitudinally spaced apart and oriented orthogonally with respect to each other. Six radially-oriented adjustable polarizer screws extend from the exterior to the interior of the waveguide. A septum intermediate the first and second pins is aligned with the first pin. Adjustment of the polarizer screws enables maximized propagation of and/or response to left hand circularly polarized electromagnetic waves by the first pin while simultaneously enabling maximized propagation of and/or response to right hand circularly polarized electromagnetic waves by the second pin.

20 Claims, 25 Drawing Sheets

U.S. PATENT DOCUMENTS

| | | | | |
|---|---|---|---|---|
| 7,277,061 | B2 * | 10/2007 | Fusco et al. | 343/778 |
| 2001/0003442 | A1 | 6/2001 | Smith | |
| 2004/0021614 | A1 | 2/2004 | Moheb | |
| 2005/0046511 | A1 * | 3/2005 | Stenberg | 333/125 |
| 2006/0017641 | A1 | 1/2006 | Yoneda et al. | |
| 2006/0132359 | A1 | 6/2006 | Chang et al. | |

OTHER PUBLICATIONS

Cushcraft Corporation, Antenna Polarization Considerations in Wireless Communications Systems, pp. 1-7, 1999-2002, http://www.cushcraft.com/comm/support/pdf/Antenna-Polarization-14B32.pdf.
Antenna Basics, pp. 63-77, http://wireless.ictp.trieste.it/handbook/C4.pdf, 15 Pages.
Flomerics, Wide-Band Short Backfire Antenna, 3 Pages, http://www.flomerics.com/unicrostripes/applications/backfire_antenna/.
Wade, Paul, W1GHZ Microwave Antenna Book, Chapter 7 Slot Antennas, 14 Pages, 2000, 2001, http://www.w1ghz.org.
Chapter 2, Antenna Fundamentals pp. 9-30.
Chen, C., Matrix Model of the Waveguide Transformer, pp. 1-24, http://www.Ins.cornell.eduipublic/SRF/2001/SRF010219-02/srf010219-02.pdf.
Subbarao, B., Fusco, V. F., Single Aperture Monopulse Horn Antenna, IEEE, pp. 1-3.
Polarization pp. 3-2.1-3-2.4, http://www.phys.hawaii.edu/~anita/web/paperwork/currently%20organizing/Military%20EW%20%20handbook%20excerpt/polariza.pdf.
Subbarao, B. and Fusco, V.F., Compact Coaxial-Fed CP Polarizer, IEEE Antennas and Wireless Propagation Letters, vol. 3, 2004 pp. 145-147.
Taqi, A.H., Al-Rashid R.A., Jassim A.M., Physics: An Experimental Investigation of a Short Backfire Antenna With Electromagnetic Coupled Patch as Feed Element, Journal of Islamic Academy of Sciences 8:2, 61-68, 1995.
Tracking and Data Relay Satellite (TDRS) Space Segment Overview, Section I: p. 4.
Paynter, G.F., Lee, Teh-Hong, Burnside, W.D., EM Programmer'S Notebook, Expansion of Existing EM Workbench for Multiple Computational Electromagnetics Codes, IEEE Antennas and Propagation Magazine, vol. 45, No. 3, Jun. 2003 pp. 122-127.
Krejcik, P., Waveguide Stub-Line Tuning of RF Cavities With Heavy Beam Loading, Slac-Pub-7544, May 1997, Stanford Linear Accelerator Center, Stanford University, Stanford, CA 94309, Contributed to 1997 Particle Accelerator Conference, Vancouver Canada, May 12-16, 1997. 4 Pages, http://www.slac.stanford.edu/cgi-wrap/getdoc/slac-pub-7544.pdf IEEE 1998 pp. 3030-3032.
Wade, Paul, Feeds for Parabolic Dish Antennas, W1GHZ Microwave Antenna Book, Chapter 6, 1998, 1999, Appendix 6A-Parabolic Dish Gain and Beamwidth 3 Pages, http://www.w1ghz.org/antbook/app-6a.pdf.
http://www.rfcafe.com/references/electrical/circular_waveguide_modes.html, Jun. 28, 2007.
John, Sarah, Electromagnetic Unification of Matter and Force Fields (Excerpts from a Talk Presented at the APS Meeting in Denver, Colorado, May 1, 2004) http://flux.aps.org/meetings/YR04/APR04/baps/abs/G300015.htm1 6 pages.
Wade, Paul, W1GHZ Microwave Antenna Book, Chapter 6, Feeds for Parabolic Dish Antennas, 1994, 1997, 1998, 1999, 23 Pages.
Airstream Community Wireless Network, Antenna Polarization, http://www.air-stream.org.au/polarization, 3 Pages.
Globalspec.com, About RF Waveguide Components, 2 Pages, http://communication-equipment. globalspec.com/LearnMore/Networking_Communication . . . .
IEEE, Ieeexplore Search, 5 Pages, http://ieeexplore.ieee.org/search/freesearchresult.jsp?history=yes&queryText=%28kory%29.
Radiolabs Inc., Radiolabs Wireless & Beyond, Backfire 2.4 Ghz Wifi Antenna, http://www.radiolabs.com/products/antennas/2.4gig/backfire.php 2 Pages.
Extremetech.com, Building a Wi-Fi Antenna Out of a Tin Can, 4 Pages, http://www.extremetech.com/article2/0,1558,1641186,00.asp.
Dod, L.R., Experimental Measurements of the Short Backfire Antenna, Oct. 1966, Goddard Space Flight Center, 43 Pages, http://ntrs.nasa.gov/archive/nasa/casi.ntrs.nasa.gov/19670009367_1967009367.pdf.
Okhmatovsky, Vladimir I., Nikita, Konstantina S., Koulouridis, Stavros, and Uzunoglu, Nikolaos K., Development of a Cylindrical Waveguide Antenna Array With a High Isolation Between Receive-Transmit Sub Arrays: Theory and Experiment, Turk J Elec Engin, vol. 10, No. 2, 2002 Tubitak pp. 307-316, http://journals.tubitak.gov.tr/elekrik/issues/elk-02-10-2/elk-10-2-13-0110-16.pdf.
Seybold, Dr. John S., Antennas, Presentation Slides, Nov. 9, 2004, IEEE Melbourne Com/SP AP/MTT Chapters, Slides 1-29, 15 Pages.
Google, Google Search for Marcuvitz Waveguide Handbook, http://www.google.com/search?sourceid=navclient&ag=t&ie=UTF-8&rls=HPIA, HPIA:20 . . . , Two Pages.
Wikipedia, Low-Noise Block Converter, http://en.wikipedia.org/wiki/Low-noise_block_converter, 4 Pages.
Wikipedia, Circular Polarization, http://en.wikipedia.org/wiki/Circular_polarization, 3 Pages.
Rabe, Carl, "My Short Backfire Antenna for 2.45GHz by Carl Rabe-G6NLC", http://www.frars.org.uk/cgi-bin/renderpl?pageid=1076, http://oasis.dit.upm.es/~jantonio/personal/eb4gpe/short_backfire.html, 9 Pages.
Hyperlink Technologies, Inc., 2.4 GHz 14 dBi Backfire Wireless Lan Antenna, Model: HG2414D, Two pages, http://www.hyperlinktech.com.
Wong, Gary G., Tamakawa, Thomas T., TDRSS Multiple Access Transmit Phased Array, Report No. 2900-330-013, TRW, 87 Pages.
Wikipedia, Short Backfire Antenna, One page http://en.wikipedia.org/wiki/Short_backfire_antenna.
Wikipedia, Antenna (Radio), 20 pages, http://en.wikipedia.org/wiki/Antenna_%28electronics%29.
Wikipedia,Orthomode Transducer, 1 Page, http://en.wikipedia.org/wiki/Orthomode_transducer.
Wikipedia, Waveguide, 2 Pages, http://en.wikipedia.org/wiki/waveguide.
Wikipedia, Waveguide (Electromagnetism), 5 Pages, http://en.wikipedia.org/wiki/waveguide_%28electromagnetism%29.
Techtarget, Waveguide, 3 Pages, http://whatis.techtarget.com/definition/0,,sid9_gci214326,00.html.
Wade, Paul, Understanding Circular Waveguide-Experimentally, Old-Fashioned Microwave Engineering, W1GHZ, QEX, Jan./Feb. 2001, pp. 37-48. http://www.w1ghz.org/QEX/circular_wg.pdf.
NASA Headquarters' Office of Space Communications and Goddard Space Flight Center's Mission Operations and Data Systems Directorate, 2nd TDRSS Workshop, held Jun. 25-26, 1996, pp. 1-16.
National Aeronautics and Space Administration, Antenna, Microwave, and Optical Systems Branch RCA, SCDS Antenna Technologies, 2 pages, http://ctd.grc.nasa.gov/organization/branches/amosb/RCA_SCDS/SCDS_TDRSS.html.

* cited by examiner

400J

400K

CUP WAVEGUIDE ANTENNA WITH INTEGRATED POLARIZER AND OMT

The invention described herein was made by employees and by employees of a contractor of the United States Government, and may be manufactured and used by the government for government purposes without the payment of any royalties therein and therefor.

FIELD OF THE INVENTION

The invention is in the field of short backfire antennas with circular cylindrical waveguides capable of simultaneously propagating and receiving left and right hand circularly polarized electromagnetic waves.

BACKGROUND OF THE INVENTION

The Tracking and Data Relay Satellite System (TDRSS) is a constellation of geosynchronous satellites which are the primary source of space-to-ground voice, data and telemetry for the Space Shuttle. The satellites also provide communications with the International Space Station and scientific spacecraft in low-Earth orbit such as the Hubble Space Telescope. Integral to the design of the TDRSS class of satellites is an architecture that includes a multiple access (MA), S-band, phased array antenna. Among its capabilities, the MA system receives and relays data simultaneously from multiple lower data-rate users and transmits commands to a single user.

An enhanced MA array antenna element was proposed which has simultaneous circular polarization capability and increased beamwidth. If developed, simultaneous circular polarization capability (left hand circular polarization (LHCP) and right hand circular polarization (RHCP)) will be required.

The proposed design specifications for the enhanced MA antenna elements are set forth below. Two bandwidth requirements, for example, narrowband and wideband are included in the specification. The wideband specification includes both the system transmit and receive bands.

TDRSS enhanced MA antenna element specifications.

| | |
|---|---|
| Narrowband frequency (GHz) | 2.2-2.3 |
| Wideband frequency (GHz) | 2.03-2.3 |
| Peak directivity (dBi) | 15 |
| Directivity at 20 degree cone (dBi) | ≧11 |
| Axial ratio (dB) | >−5 dB |
| Polarization | Simultaneous LHCP and RHCP |
| Return loss (dB) | ≦−20 |
| Isolation (dB) | ≦−10 |

Short backfire antennas are widely used for mobile satellite communications, tracking, telemetry and wireless local network applications due to their compact structure and excellent radiation characteristics. Typically these antennas consist of half-wavelength dipole excitation elements for linear polarization or crossed half-wavelength dipole elements for circular polarization. To achieve simultaneous dual circular polarization using the related art would require integrating a network of hybrid switching components which introduces significant losses as well as disadvantages as to cost reliability, etc.).

Helix antennas naturally provide circular polarization. However, achieving dual circular polarization requires placing two helix antennas with opposite helical windings side by side, or a dual feeding arrangement. Placing helical antennas in proximity to each other can be problematic in the sense that coupling of the electromagnetic waves of one antenna to the other can occur absent a separation structure which would add weight to the assembly.

An article entitled "Compact Coaxial-Fed CP Polarizer," by B. Subbarao and V. F. Fusco, IEEE Antennas and Wireless Propagation Letters, Vol. 3, 2004, states: " . . . we use a circular waveguide with metal post inserts . . . to obtain a CP wave from an LP input, a 90° phase shift must be induced in one of the orthogonal components E‖ or E⊥, of the linearly polarized wave E which is applied at 45° to the post arrangement . . . . This phase shift is obtained by introducing slightly different phase constants for E‖ or E⊥. These are introduced by metal rods of equal size and spacing positioned diametrically across the aperture of the waveguide section. An equivalent circuit for a simplified version of this type of arrangement given in [ ] suggests that the inductance of these posts, together with their capacitive coupling, is providing the E‖ component with an impedance matched high-pass equivalent circuit thus advancing the phase of this component relative to its orthogonal component which propagates at normal waveguide phase velocity. By judicious design E‖, E⊥ components can be made to have equal amplitudes, hence if the length of the differential phase delay is made to be 90°, the exit signal will be a circularly polarized wave."

An article entitled "Short Backfire Antenna With Conical Back Reflector And Double Small Front Reflectors by A. A. Ahmed, Journal of Islamic Studies, (9:2, 49-52, 1996 discloses "a conical back reflector and double plane small front reflectors fed through an open-ended circular waveguide excited with the dominant $TE_{11}$ mode." and which "shows a relatively high gain (17.2 dB)." Another article entitled "Experimental Measurements Of The Short Backfire Antenna" by L. R. Dod, October 1966, NASA Goddard Space Flight Center, Greenbelt Md., Technical Manual X-525-66-490 states on page 3 thereof that: "[t]he short backfire antenna is a medium gain antenna (10-15 dB.) with low side and back radiation. The antenna can be cross-polarized for orthogonal linear or circular polarization . . . . The addition of a λ/4 rim on the large reflector is necessary for low back radiation . . . . The short backfire may also serve advantageously as an array element."

Polarization of an electromagnetic wave is defined as the orientation of the electric field vector. In a transverse electromagnetic (TEM) wave, the electric field vector is perpendicular to the direction of travel and it is also perpendicular to the magnetic field vector. Linear polarization is commonly referred to as vertical or horizontal polarization depending on the orientation of the emitter with respect to some local frame of reference. If there are two orthogonal emitters and if they are out of phase then an elliptical pattern is traced by the tip of the electric field vector as a function of time on a fixed plane through which the combined electromagnetic wave passes. A special case of the elliptical polarization is circular polarization where the orthogonal components are equal in magnitude and 90° out of phase.

The present invention discloses a short backfire antenna in combination with a cylindrical waveguide which includes an orthomode transducer (OMT), septum and adjustable impedance screws (polarizers) enabling simultaneous propagation and/or reception of two oppositely oriented circularly polarized electromagnetic waves. None of the foregoing references disclose this unique assembly of features and functions.

SUMMARY OF THE INVENTION

The cup cylindrical waveguide antenna includes a short backfire antenna. The antenna further includes a dual reflector system circular disk subreflector and a circular cup. A cylindrical waveguide structure is utilized for antenna excitation. Dual, simultaneous, circular polarization is achieved using a compact 6-post polarizer integrated into the cylindrical waveguide. The cylindrical (circular) waveguide also includes an orthomode transducer with coaxial ports and pins to achieve simultaneous dual polarization. This design technique allows a compact circular waveguide, orthomode transducer and polarizer to be implemented in approximately 11 inches at S-band, substantially less space than a commercially available model measuring approximately 32 inches at the same frequency. Scaling of the cup cylindrical waveguide antenna for use at other frequencies is within the scope of the invention.

Narrowband Cup Waveguide Antenna

The narrowband frequency bandwidth specification is 2.2-2.3 GHz. The cup waveguide is a type of short backfire antenna (SBA). Short Backfire Antennas (SBAs) are dual reflector systems widely utilized for mobile satellite communications, tracking, telemetry, and wireless local area network (WLAN) applications due to their compact structure and excellent radiation characteristics. SBAs typically use a dipole or cross-dipole exciter, circular disk subreflector, and a circular cup. Similarly, the cup waveguide antenna is a dual reflector system with circular disk subreflector and circular cup. However, unlike conventional SBAs it uses a circular waveguide exciter. To achieve circular polarization, a compact 6-post polarizer is integrated into the circular waveguide somewhat similar to that described in the article entitled "Compact-Coaxial Fed CP Polarizer" identified herein above. The circular waveguide also includes an orthomode transducer (OMT) with coaxial ports to achieve simultaneous dual polarization. The overall length of the OMT and polarizer is about 11" compared to approximately 32" for a commercially available model.

The aforementioned subreflector is held in place within the cup using an EPS (expandable polystyrene) cylinder anchored inside the excitation waveguide.

Wideband Cup Waveguide Antenna

The wideband frequency bandwidth specification is 2.03-2.3 GHz. To accommodate the larger bandwidth, the narrowband cup waveguide design was modified to include a larger excitation circular waveguide diameter. In addition, the antenna includes a conical cup and two subreflectors. Other bandwidth driven changes to the design include an increase of cup diameter to about 12.15 inches to meet the gain specification, and the addition of a tuning screw to the OMT to maintain the return loss specification. Return loss is another way of expressing impedance mismatch. It is a logarithmic ratio measured in dB that compares the power reflected by the antenna to the power fed into the antenna. To achieve circular polarization a compact 6-post polarizer was used. In this case six polarizer screws were used to test adjustable insertion distances into the compact polarizing section of the waveguide. Once the insertion distances were determined, they were replaced with non-adjustable posts. A single adjustable tuning screw was added diametrically across from and longitudinally near the second port and second pin location.

The invention disclosed herein represents a significant savings in mass and size as compared to existing technology. Simulations for the antennas described herein used the three-dimensional electromagnetic software entitled Microwave Studio. Compared to a helix antenna, the design and fabrication of the instant invention is somewhat more complex since the polarizer and OMT require several additional components. Assembly was fairly straightforward, but the antenna required fine tuning, which was complicated by the additional variables of the polarizer screw depths, coaxial port pin lengths, and the subreflector height above the circular waveguide.

It is an object of the present invention to provide an antenna which includes a cylindrical waveguide having a pair of longitudinally spaced orthogonal ports, each of the ports includes a pin, having a septum intermediate to the pins, and, having an adjustable impedance matching mechanism.

It is a further object of the invention to provide an antenna wherein the adjustable impedance matching mechanism is a screw.

It is a further object of the invention to provide an antenna having a cup and a subreflector, the cup is affixed to the waveguide, the cup includes a reflector, and, the subreflector is separated apart from the reflector.

It is an object of the present invention to provide a short backfire antenna in combination with a cylindrical waveguide having impedance transforming structures enabling the propagation and reception of simultaneous right and left hand circular polarized electromagnetic waves in the range of 2.03 to 2.3 GHz.

It is an object of the present invention to provide a corrugated horn in combination with a cylindrical waveguide having polarization transforming structure enabling the propagation and reception of simultaneous right and left hand circular polarized electromagnetic waves.

It is an object of the present invention to provide a corrugated horn in combination with a cylindrical waveguide wherein the waveguide includes a septum aligned with one of the pins of one of the orthogonal ports.

It is an object of the present invention to provide an antenna having a waveguide which includes six adjustable polarizer screws.

It is an object of the present invention to provide an antenna which is short in length and light weight which meets the specification set forth above.

It is an object of the present invention to provide an antenna for communicating left and right hand circularly polarized electromagnetic waves utilizing a waveguide which includes an exterior and an interior, an orthomode transducer including first and second pins longitudinally spaced apart and oriented orthogonally with respect to each other, six radially-oriented adjustable polarizing screws extending from the exterior to the interior of the waveguide, a septum intermediate to the first and second pins aligned with the first pin, adjustment of the screws enables maximized propagation of left hand circularly polarized electromagnetic waves by the first pin and/or enables maximized response to left hand circularly polarized waves by the first pin; and, adjustment of the screws enables maximized propagation of a right hand circularly polarized electromagnetic waves by the second pin and/or enables maximized response to a right hand circularly polarized electromagnetic waves.

It is an object of the invention to provide three posts or screws diametrically across the aperture of the waveguide from three other posts or screws.

It is an object of the invention to provide additional posts numbering greater than six in a diametrical relationship.

These and other objects of the invention will be best understood when reference is made to the Brief Description of the Drawings, the Description of the Invention and the Claims which follow hereinbelow.

The drawings will be best understood when reference is made to the Description of the Invention and the Claims which follow hereinbelow.

DESCRIPTION OF THE INVENTION

Figure 1:
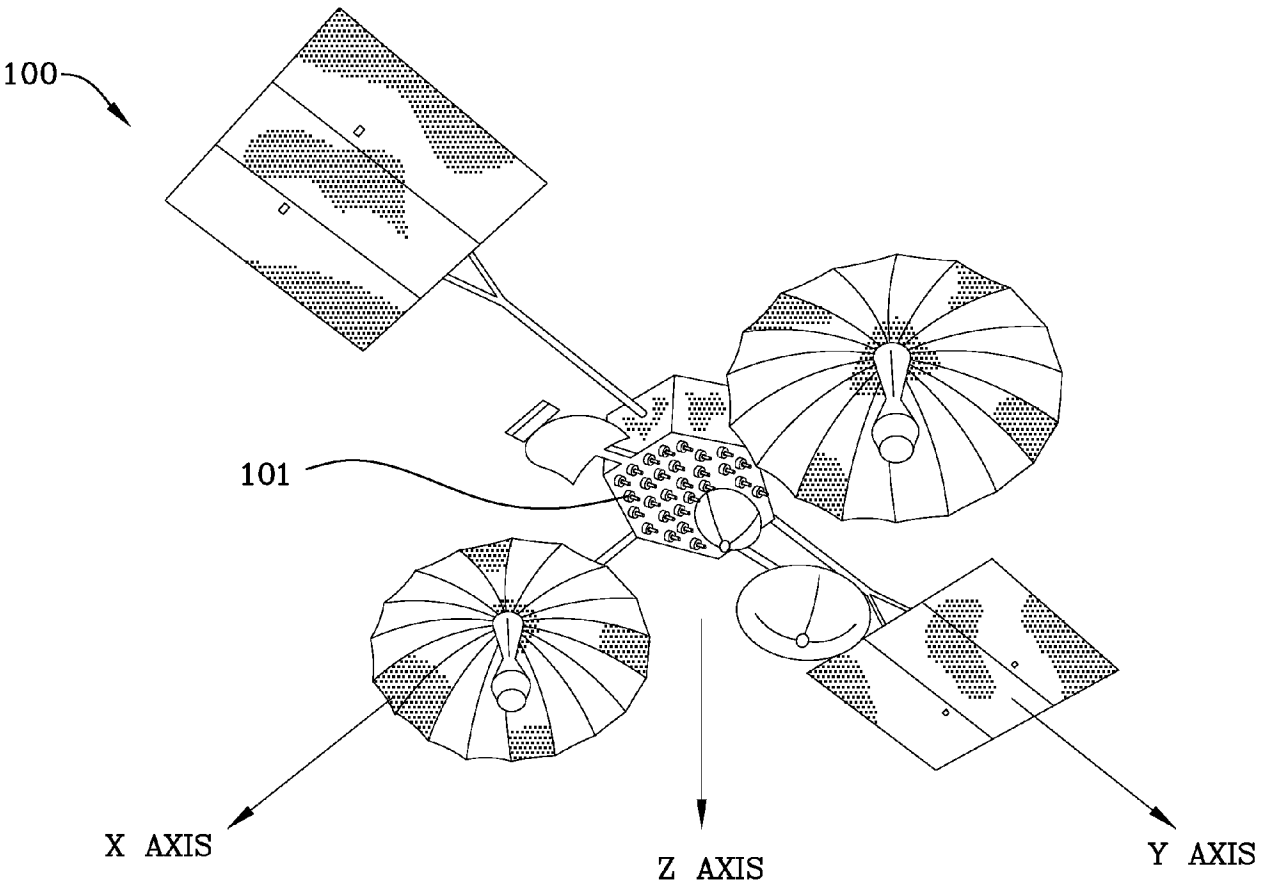
FIG. 1 is a schematic view of tracking and data relay satellite (TDRS).

FIG. 1 is a schematic view 100 of the tracking and data relay satellite (TDRS). Reference numeral 101 is an array of 32 antenna elements which are used for communication. These antenna elements are the subject of the invention.

Figure 2:
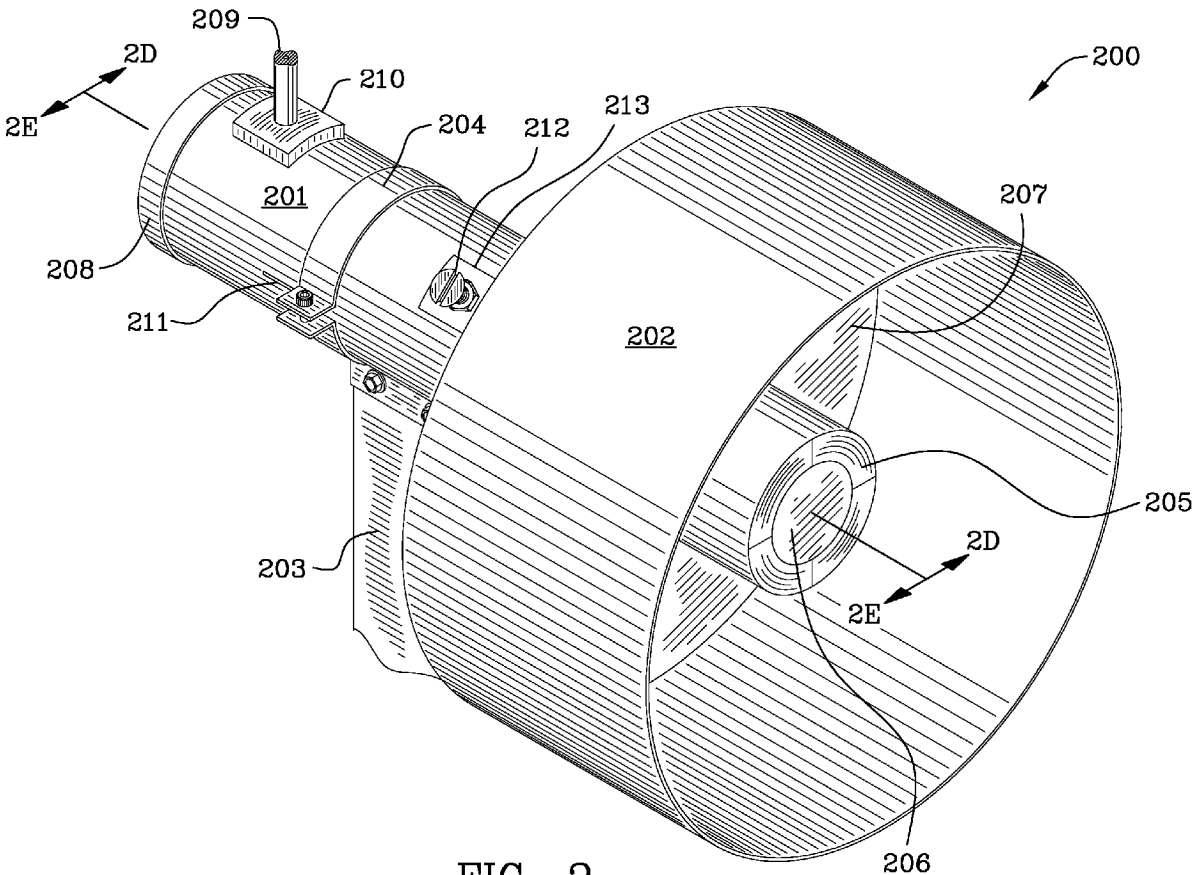
FIG. 2 is a left front perspective view of narrowband cup waveguide antenna.
Figure 2A:
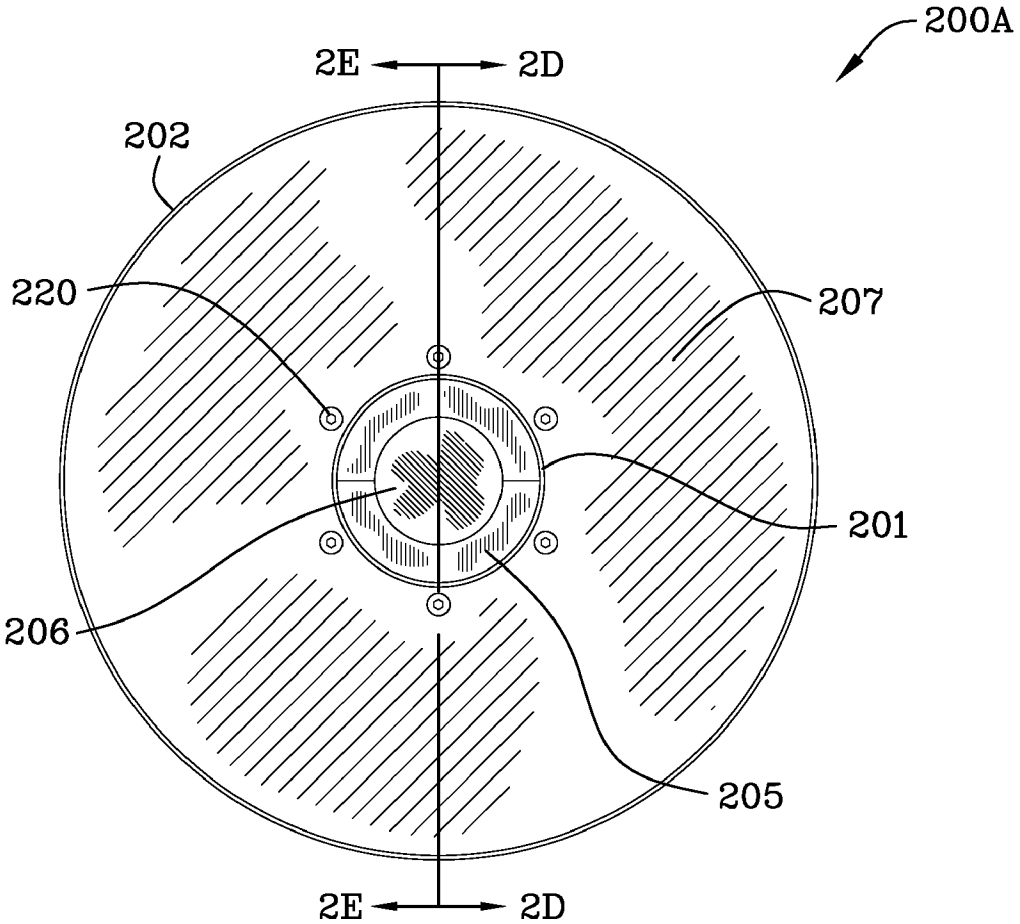
FIG. 2A is front view of the narrowband cup waveguide antenna.

FIG. 2 is a left front perspective view 200 of the narrowband cup waveguide antenna. FIG. 2A is a front view 200A of the narrowband cup waveguide antenna illustrating a portion of the cylindrical waveguide 201, narrowband cup 202, screws 220 affixing the narrowband cup to the waveguide, subreflector 206 supported by the EPS (expanded polystyrene) 205 and the reflector 207 of the cup. Aluminum or other light weight metal is used in the construction of all of the antenna components except for the SMA (SubMiniature version A) coaxial connectors 209 are used as an interface for coaxial cable type coupling mechanisms. SMA connectors typically have a 50Ω impedance. Mounting block 210 is secured to the exterior of the cylindrical waveguide 201 with adhesive or some other mounting mechanism.

The narrowband cup 202 has a 10.585 inch diameter (about at 2.25 GHz) and has a rim height of approximately 5.421 inches. The cup reflector 207 is preferably polished Aluminum and the subreflector 206 is mounted approximately 3.873 inches away from the reflector 207. The diameter of the subreflector 206 is approximately 1.807 inches. Overall length of the narrowband cup and the cylindrical waveguide 201 is approximately 15.17 inches. Subreflector 206 is supported by EPS (Expandable Styrene) which is inserted and secured within the approximate 3.614 inch inner diameter of the cylindrical waveguide 201. The outer diameter of the cylindrical waveguide is approximately 3.850 inches. Subreflector 206 may be adhesively affixed to the Expandable Styrene or it may be embedded therein.

Still referring to FIG. 2, support 203 and clamp 204 are illustrated by way of example as one possible method for securing the antenna to a satellite. Cylindrical waveguide end cap 208 includes a highly polished inner portion 208S which acts as a back short to electromagnetic waves within the waveguide. See FIG. 2W which is a cross-sectional view 200W of the waveguide taken along the lines 2W-2W of FIG. 2B. Cylindrical end cap 208 is affixed to the cylindrical waveguide 201 with an interference fit or some type of mechanical affixation such as adhesive, set screws, threads, welding, etc.

Figure 2B:
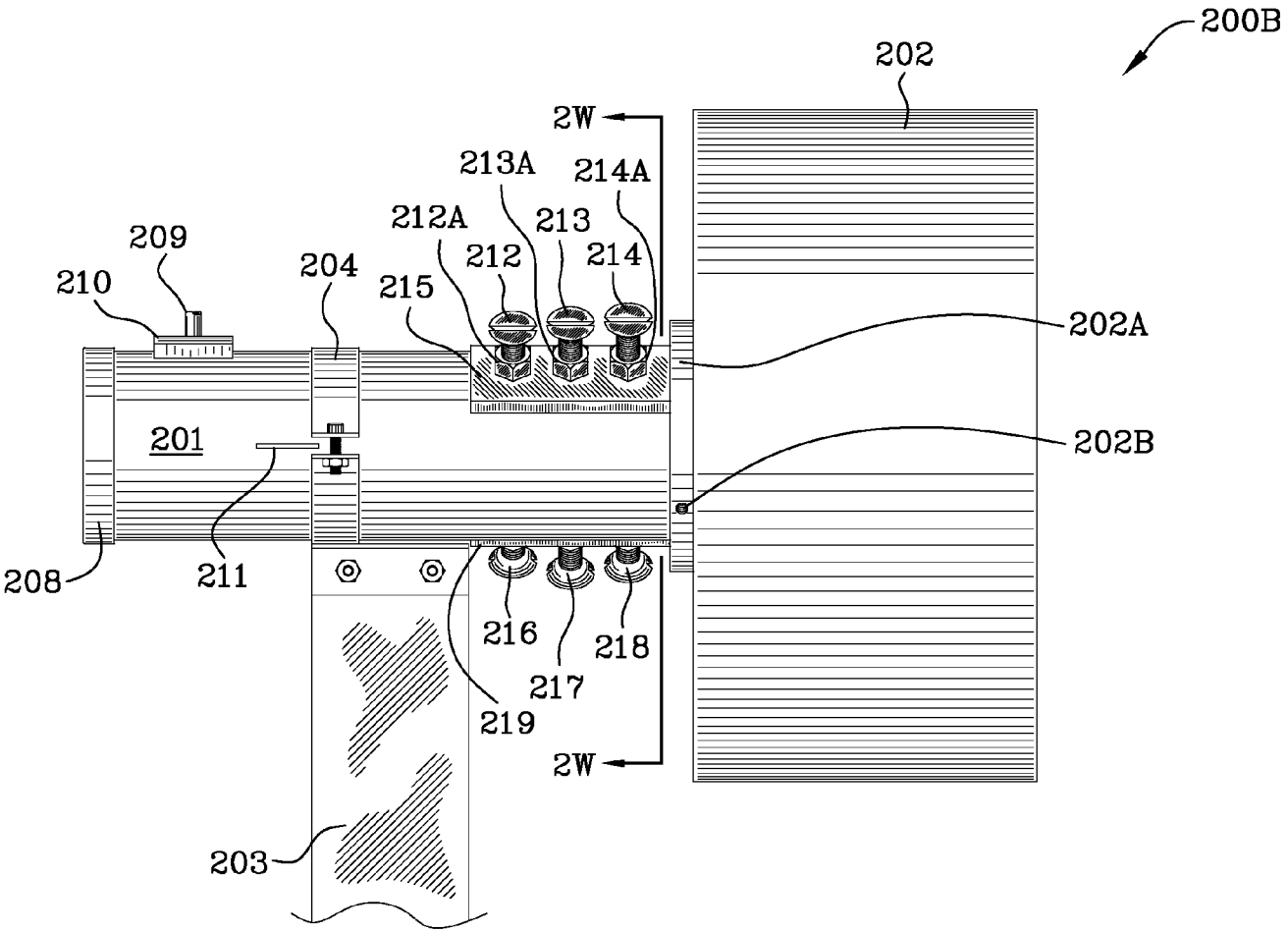
FIG. 2B is a left side view of narrowband cup waveguide antenna.
Figure 2C:
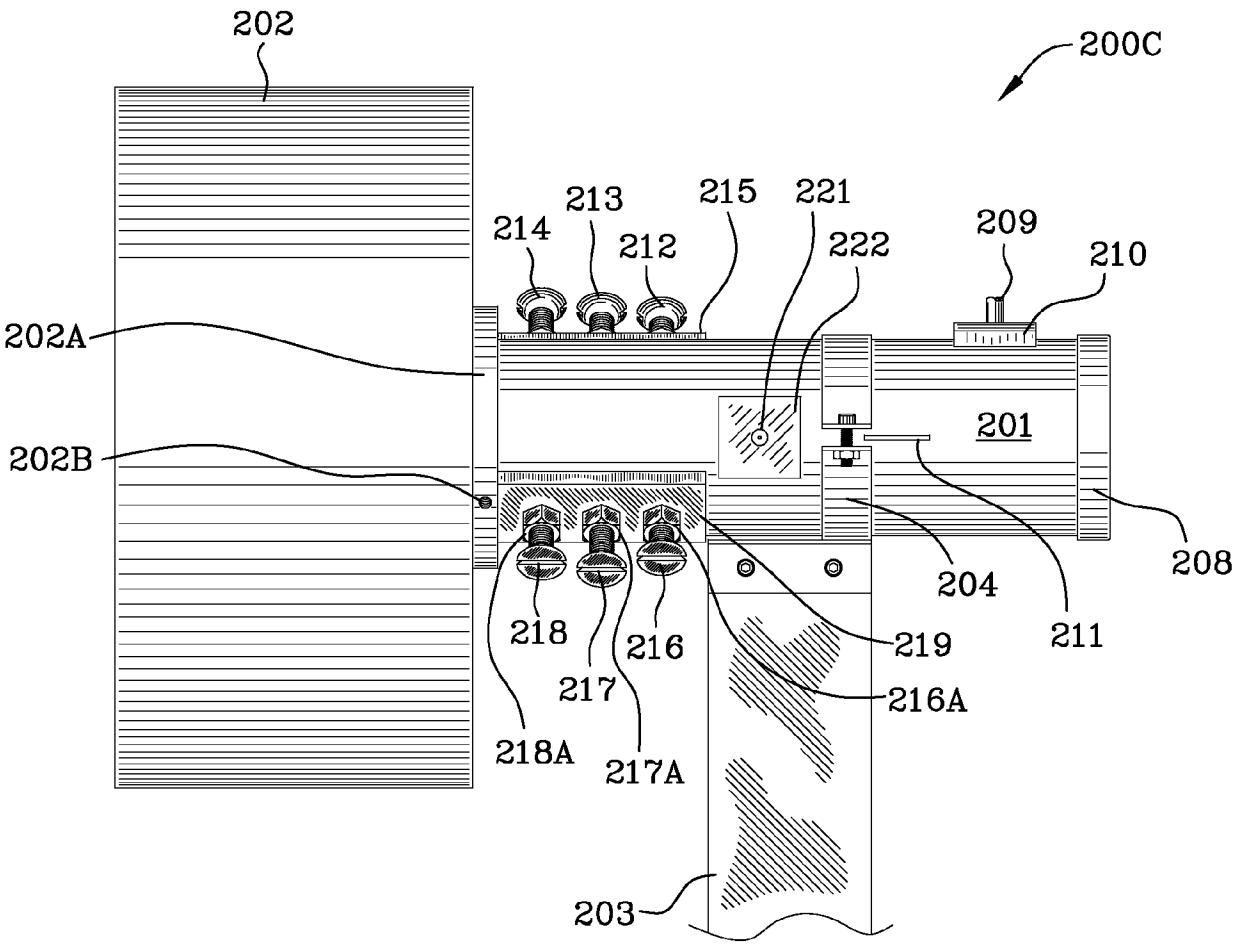
FIG. 2C is a right side view of the narrowband cup waveguide antenna.
Figure 2D:
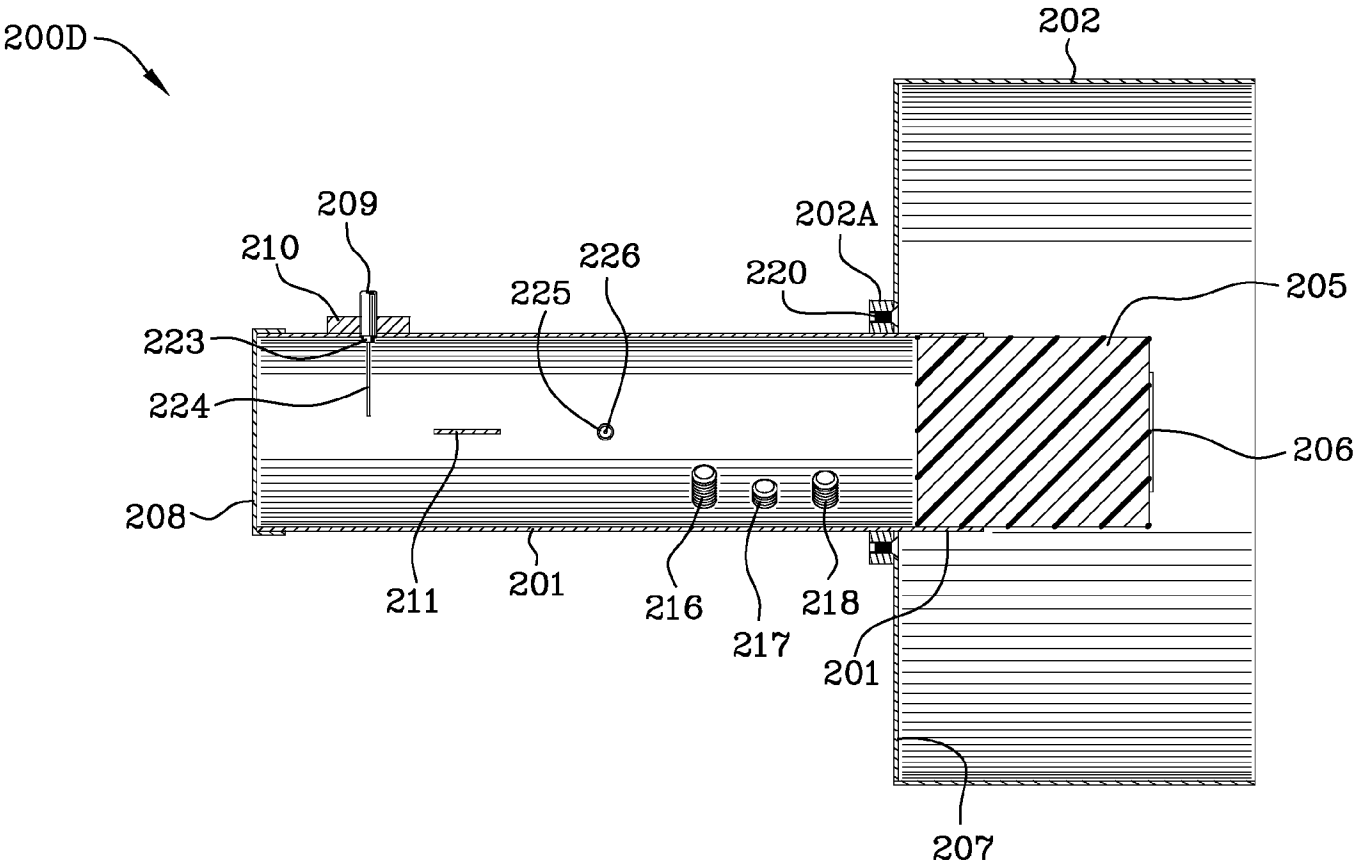
FIG. 2D is a partial cross-sectional view of the narrowband cup waveguide antenna taken along the lines 2D-2D of FIGS. 2 and 2A.
Figure 2E:
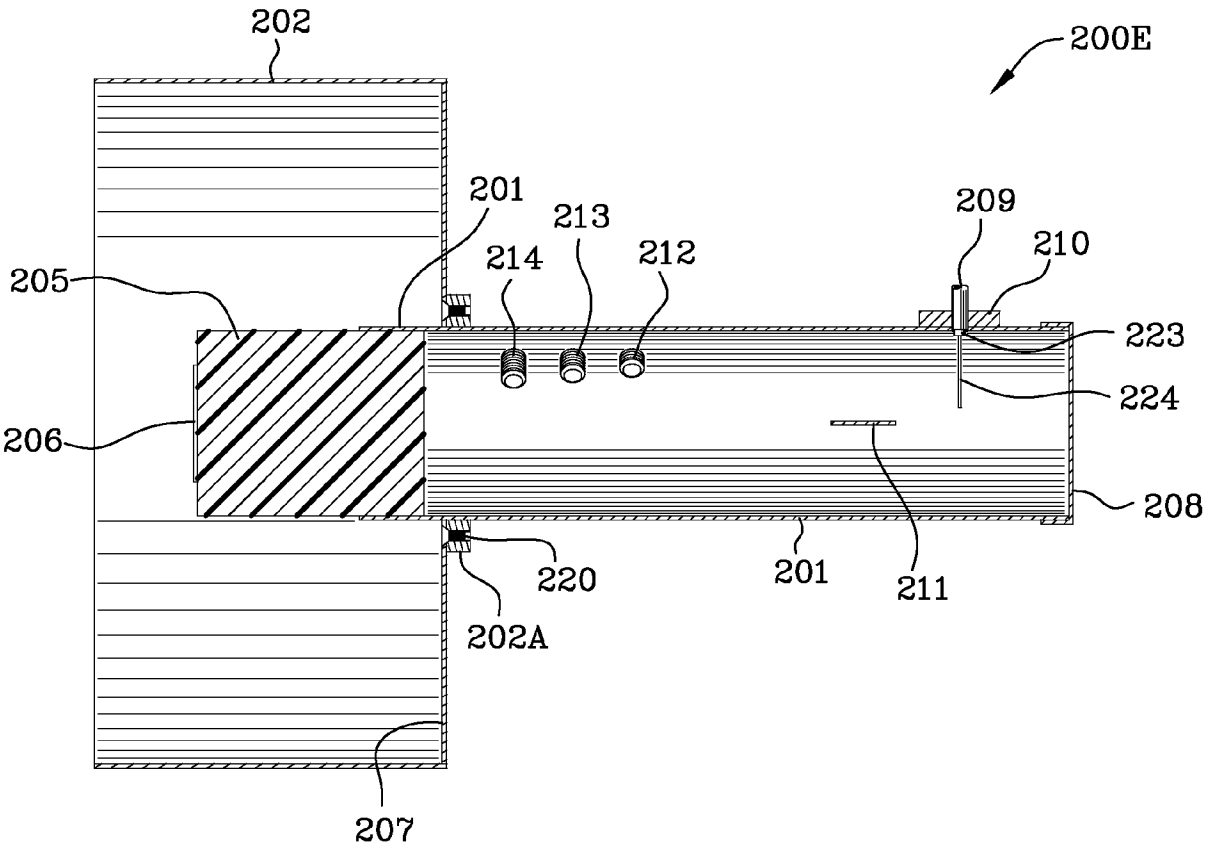
FIG. 2E is a partial cross-sectional view of the narrowband cup waveguide taken along the lines 2E-2E of FIGS. 2 and 2A.
Figure 2F:
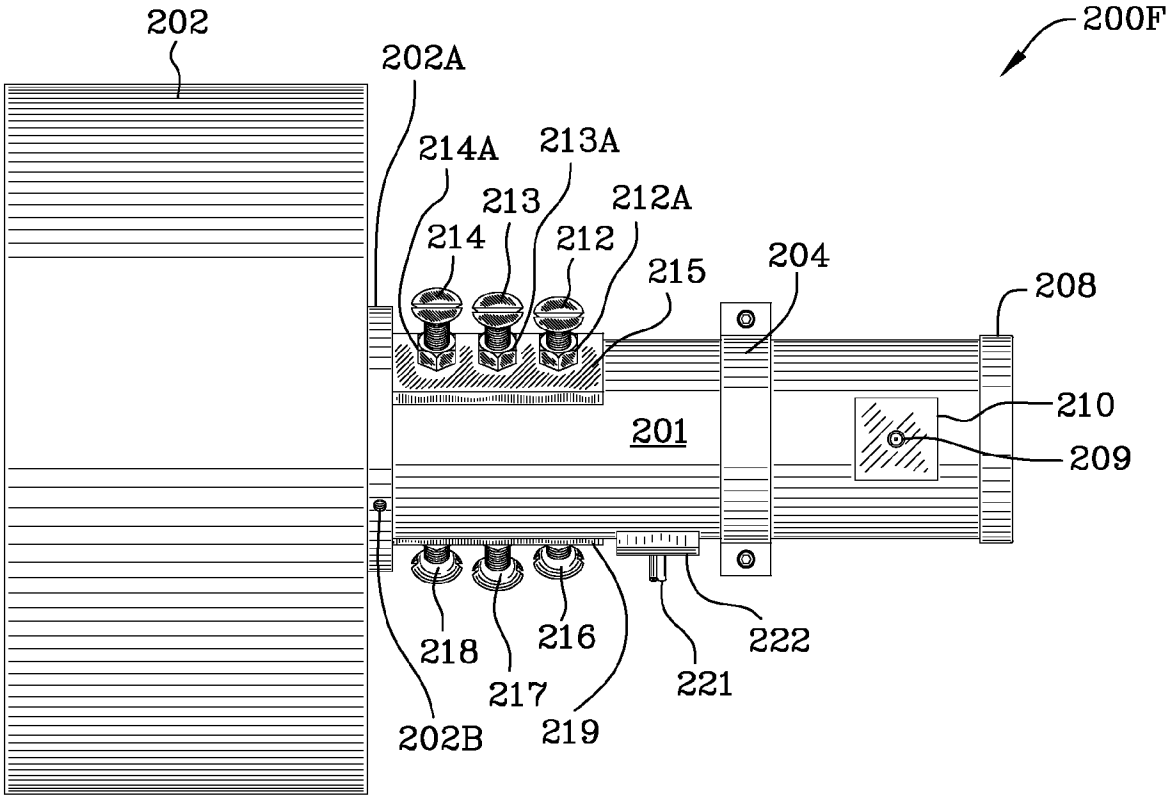
FIG. 2F is a top view of the narrowband cup waveguide antenna.
Figure 2G:
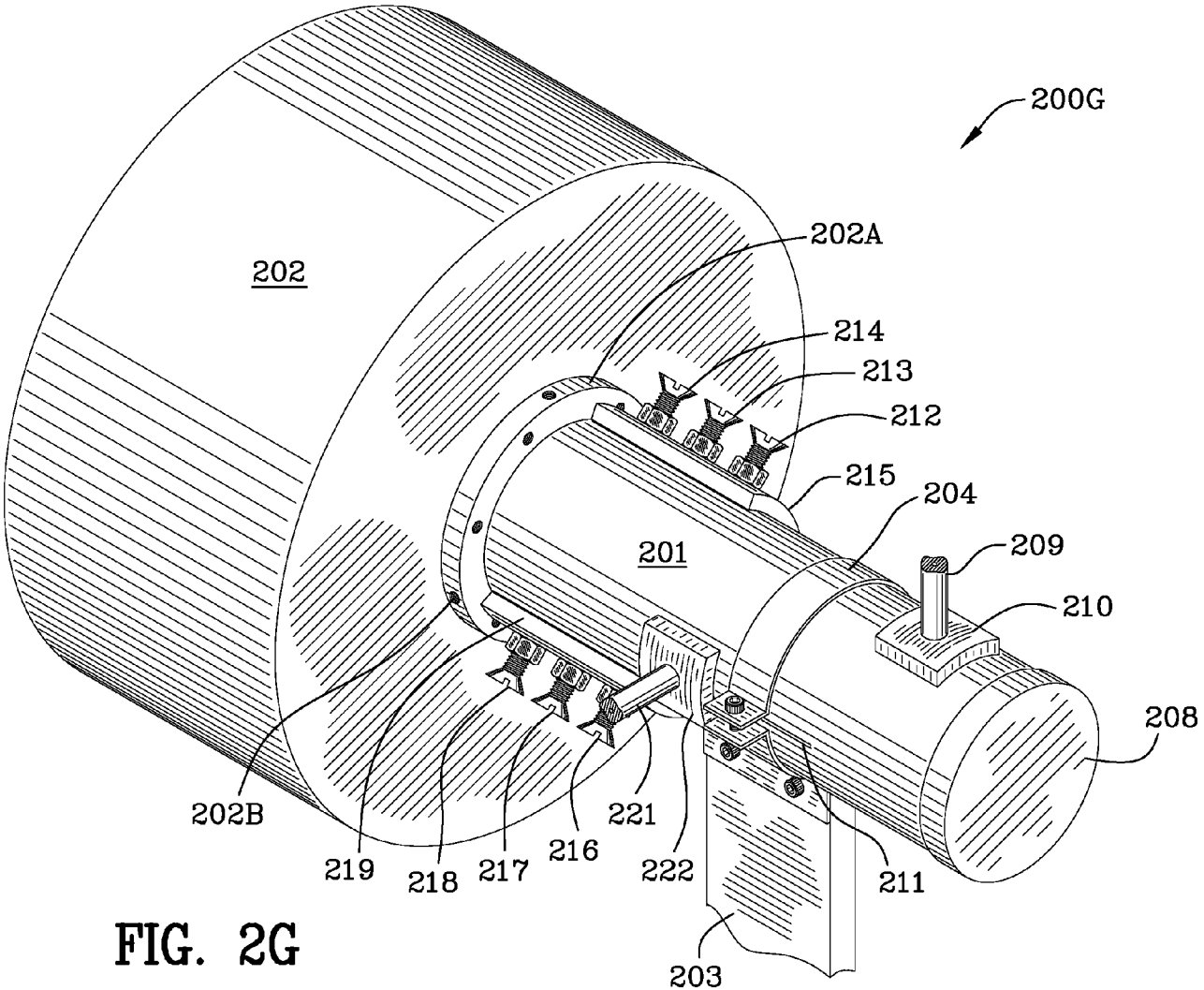
FIG. 2G is a right rear perspective view of the narrowband cup waveguide antenna.
Figure 2H:
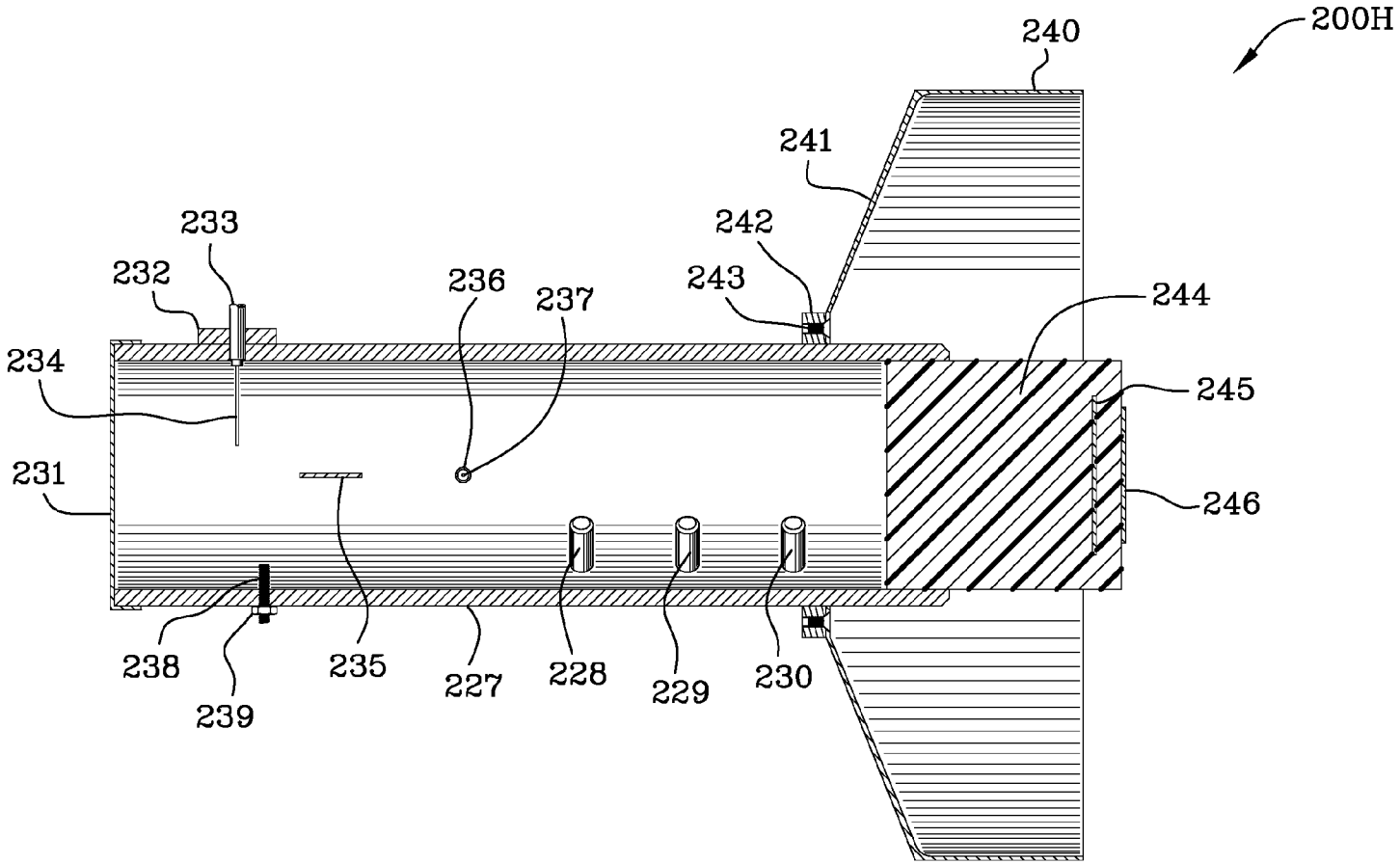
FIG. 2H is a cross-sectional view of the wideband conical cup waveguide antenna.
Figure 2I:
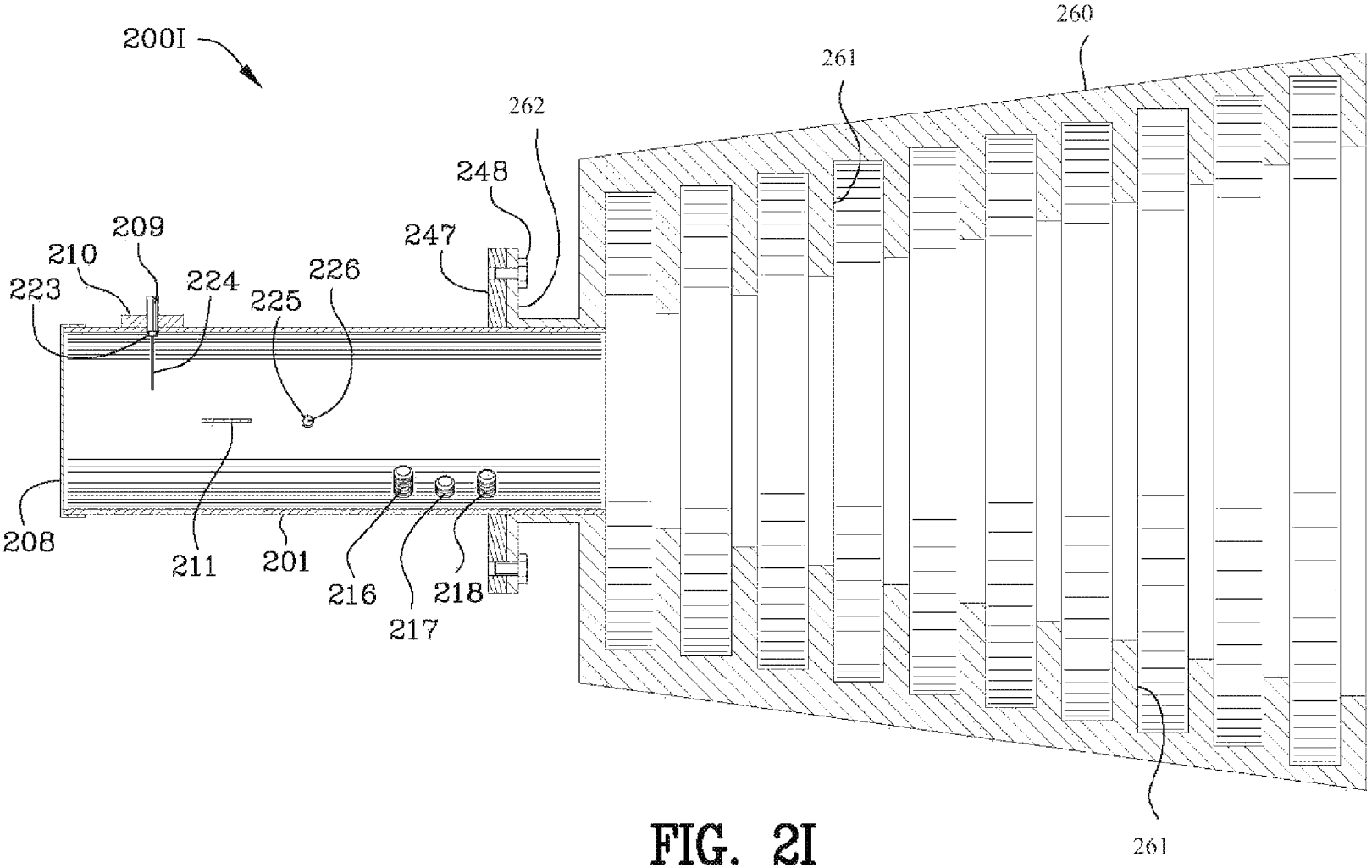
FIG. 2I is a cross-sectional view of the corrugated horn waveguide antenna.
Figure 2W:
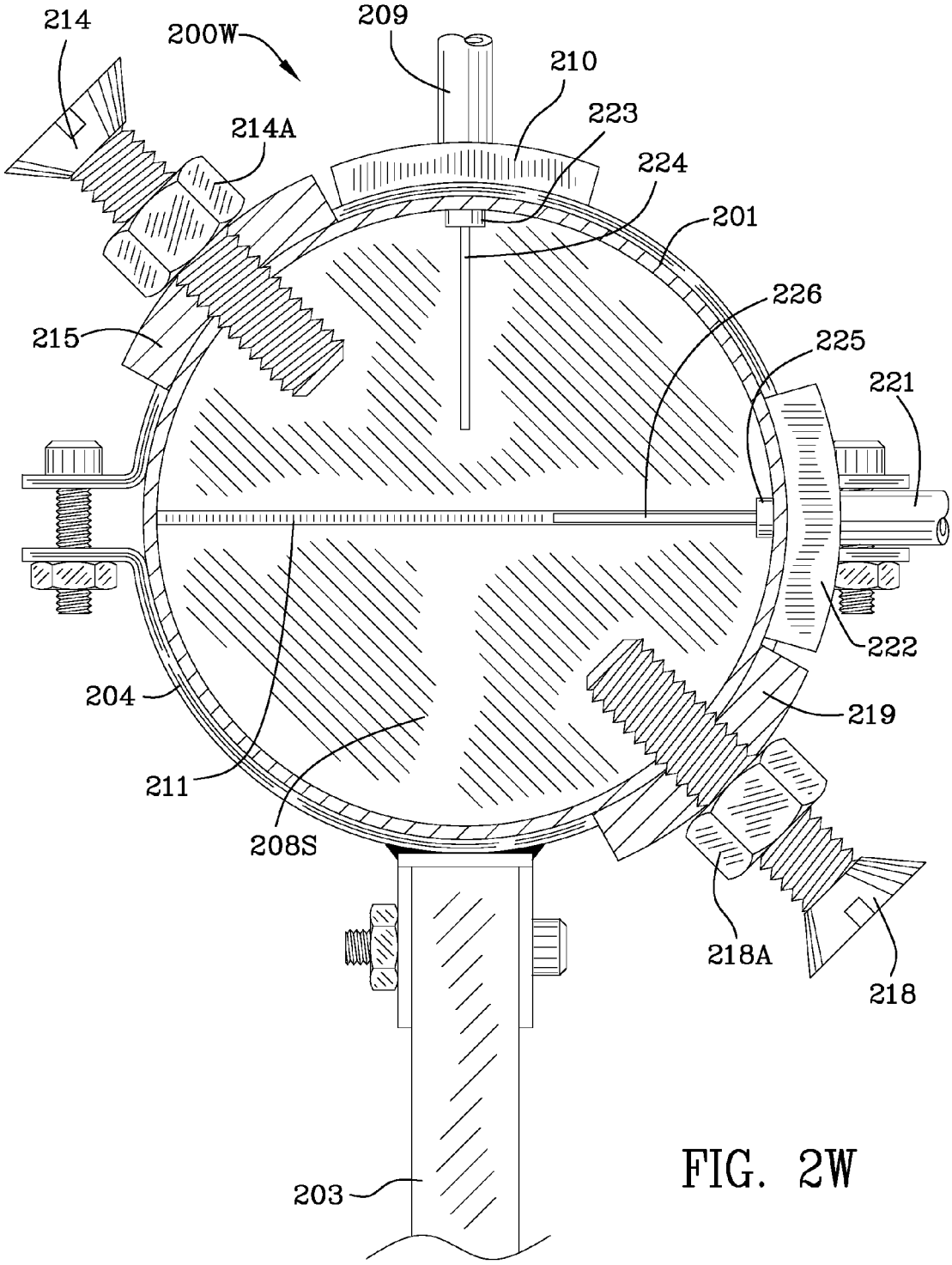
FIG. 2W is a cross-sectional view of the waveguide taken along the lines 2W-2W of FIG. 2B.

FIG. 2W is a cross-sectional view 200W of the cylindrical waveguide taken along the lines 2W-2W of FIG. 2B. FIG. 2W shows a cross-section of the polarizer and orthomode transducer (OMT) illustrating the orientation of the coaxial ports, polarizer screws, and septum plate (which acts as a back short to the first port first pin 226.

Septum 211 is approximately 0.0625 inches thick and is adhesively or mechanically secured in a receiving slot in the waveguide. Referring to FIG. 2W, the septum 211 extends across the exterior diameter of the waveguide and is flush therewith such that no part of the septum protrudes out of the waveguide. Septum 211 acts as a back short for first pin 226 which is the center conductor of the coaxial port 1 connector 221.

Still referring to the FIG. 2W, the first port of the waveguide includes a first pin 226 which extends radially 1.21 inches into waveguide 201. Sometimes herein the structure identified as the first pin 226 may be referred to as the first port. First pin 226 has a diameter of 0.036 inches and is aligned along the centerline of the septum 211. As previously indicated the septum is 0.0625 inches thick and is thicker than the 0.036 inch diameter of the first pin 226. A portion of the dielectric 225 of the SMA connector 221 may or may not extend into the waveguide 201 through mounting block 222. The first pin 226 is located distally with respect to the back short 208S. Second pin 224 extends radially 1.19 inches into waveguide 201. Sometimes herein the structure referred to as the second pin 224 may be referred to as the second port. A portion of dielectric 223 of the SMA connector 209 may or may not extend in the waveguide 201 through mounting block 210. Mounting blocks 210 and 222 are secured (by adhesive or other means of affixing metal blocks to cylindrical devices) to the exterior of the waveguide and may include threads therein for interengagement with the SMA connectors.

The dimensions in inches of the narrowband cup waveguide antenna, polarizer and orthomode transducer are summarized below.

| | |
|---|---|
| Cylindrical waveguide 201 inner diameter | 3.614 |
| Cylindrical waveguide 201 outer diameter | 3.850 |
| Septum 211 plate thickness | 0.0625 |
| Coax port 1 first pin 226 depth into waveguide | 1.21 |
| Coax port 2 second pin 224 depth into waveguide | 1.19 |
| Polarizer screw 212, 213, 214, 216, 217, 218 depth into waveguide | 0.80 |
| Polarizer screw 212, 213, 214, 216, 217, 218 diameter | 0.375 |
| First 226 and second 224 coax port pin diameter | 0.036 |

Still referring to the FIG. 2W, polarizer screws 214, 218 are nominally 0.375 inches in diameter and extend radially from the exterior of the waveguide 201 into the interior of the waveguide. Nominally, the insertion depth of screws 214, 218 into the waveguide is approximately 0.80 inches. There are two additional polarizer screws behind each of polarizer screws 214, 218 which are not illustrated in FIG. 2W for clarity. The additional screws would be viewed in FIG. 2W if at least one of the polarizer screws is adjusted to a different depth. The polarizer screws are made of an electrically conductive material which interacts with the electromagnetic waves in the cylindrical waveguide. Lock nuts 214A, 218A secure the adjustable screws 214, 218 to the desired depth. Each additional polarizer screw hidden behind screws 214 and 218 have respective lock nuts also not shown and hidden by lock nuts 214A and 218A in FIG. 2W. Threads in mounting blocks 215, 219 and the waveguide 201 interengage the corresponding threads on the adjustable screws 214, 218. Mounting blocks 215, 219 are secured to the waveguide with adhesive or with mechanical structure not shown.

The cylindrical waveguide 201 is used in conjunction with the short backfire antenna. The short backfire antenna includes waveguide cup 202, reflector 207, waveguide 201 protruding into the waveguide cup 202 and the subreflector 206 supported by the EPS form the narrowband cup waveguide antenna.

Still referring to FIG. 2W, first pin 226 and second pin 224 are diametrically the same size and are oriented at 90° with respect to each other. First pin 226 propagates linearly polarized electromagnetic waves which are transformed by the polarizer screws 212-214 and 216-218 into left hand circularly polarized waves. First pin 226 also receives linearly polarized electromagnetic waves transformed from incident left hand circularly polarized electromagnetic waves by the polarizer screws 212-214 and 216-218.

Second pin 224 propagates linearly polarized electromagnetic waves which are transformed by the polarizer screws into right hand circularly polarized waves. Second pin 224 receives linearly polarized electromagnetic waves transformed from incident right hand circularly polarized electromagnetic waves which are transformed by the polarizer.

Screws 212, 213 and 214 are located at an angle of 45° counterclockwise from second pin 224. Screws 216, 217 and 218 are located at an angle of 45° clockwise from first pin 226. Screws 212-214 extend radially inwardly into the waveguide aperture and are located diametrically opposite screws 216-218 which also extend radially inwardly into the waveguide aperture.

FIG. 2W shows a cross-sectional view of the polarizer and OMT. The polarizer screw interspacing and depth into the waveguide were varied to optimize axial ratio. Then, the position of the septum plate and length of the port 1 coaxial pin (226) were varied to optimize the port 1 return loss. The position of the back waveguide short and the length of the port 2 coaxial pin (224) were varied to optimize the port 2 return loss.

FIG. 2B is a left side view 200B of narrowband cup waveguide antenna. Mounting ring 202A is secured to waveguide 201 by set screw 202B. Port 1 coaxial pin 1 226 is not shown in FIG. 2B. FIG. 2B illustrates polarizer screws 212-214 and 216-218 inserted at various depths into the waveguide.

FIG. 2C is a right side view 200C of the narrowband cup waveguide antenna illustrating the coaxial connector 221 affixed to the mounting block 222. Polarizing screws 216-218 are illustrated with various insertion depths. FIG. 2D is a partial cross-sectional view 200D of the narrowband cup waveguide antenna taken along the lines 2D-2D of FIGS. 2 and 2A and illustrates the polarizer screws 212-214, 216-218 and OMT (first pin 226 and second pin 224). Mounting ring 202A is illustrated as are screws 220 which affix the narrowband cup to the waveguide. The narrowband cup 202 includes a rim, reflector 207 and subreflector 206, and waveguide positioned to form a backfire antenna coupled to the cylindrical waveguide 201 to form the narrow band cup waveguide antenna. FIG. 2D illustrates the adjustable polarizer screws protruding through the wall of the cylindrical waveguide 201. First pin 226 and second pin 224 are orthogonally arranged and longitudinally spaced. First pin 226 (first port) creates a left hand circularly polarized electromagnetic wave and second pin 224 (second port) creates a right hand circularly polarized electromagnetic wave. Septum 211 is thicker than first pin 226 and is aligned therewith to form a back short with respect to first pin 226. Septum 211 as viewed in FIG. 2D resides intermediate to the first 226 and the second pin 224.

The open end of the waveguide 201 resides within the narrowband cup and is 2.4 inches from the centerline of the first polarizing screw 218. The centerline of the second polarizer screw 217 is 0.920 inches from the centerline of the first polarizer screw 218. The centerline of the third polarizer screw 216 is 0.920 inches from the centerline of the second polarizer screw 217. First pin 226 resides 1.5 inches from the centerline of the third polarizer screw 216. The leading edge of septum 211 is spaced 1.6 inches from the centerline of the first pin 226 and is radially aligned with the first pin 226. First pin 226 has a diameter of 0.036 inches and the septum 211 is 0.0625 inches thick and 1.0 inch in longitudinal extent. Second pin 224 is oriented at a right angle to septum 211 and first pin 226 and is located 1 inch from the trailing edge of septum 211. The inner surface 208S of the end cap (not labeled in FIG. 2D) is spaced 1.7 inches from second port pin 224.

FIG. 2E is a partial cross-sectional view 200E of narrowband cup waveguide taken along the lines 2E-2E of FIGS. 2 and 2A and illustrates the polarizer and OMT similarly to FIG. 2D. FIG. 2F is a top view 200F of the narrowband cup waveguide antenna.

FIG. 2G is a right rear perspective view 200G of the narrowband cup waveguide antenna which illustrates three polarizing screws 212-214 located 180° from the other three polarizing screws 216-218 with all of the screws radially extending into and through the circular waveguide 201.

Figure 3A:
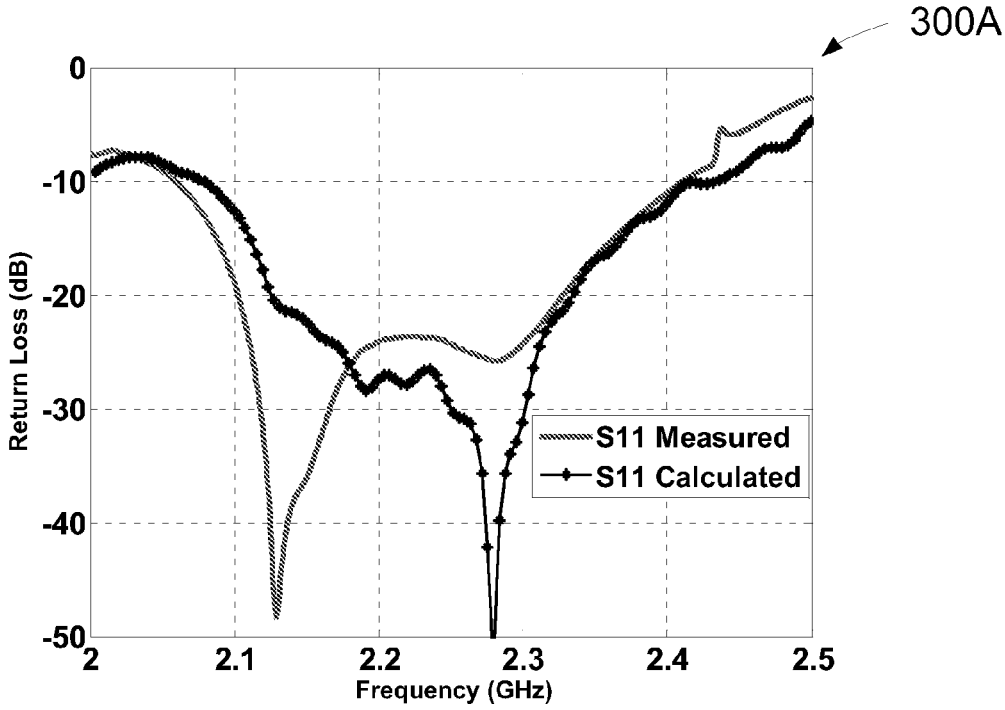
FIG. 3A is a graph of return loss versus frequency for port 1 of the narrowband cup waveguide antenna.
Figure 3B:
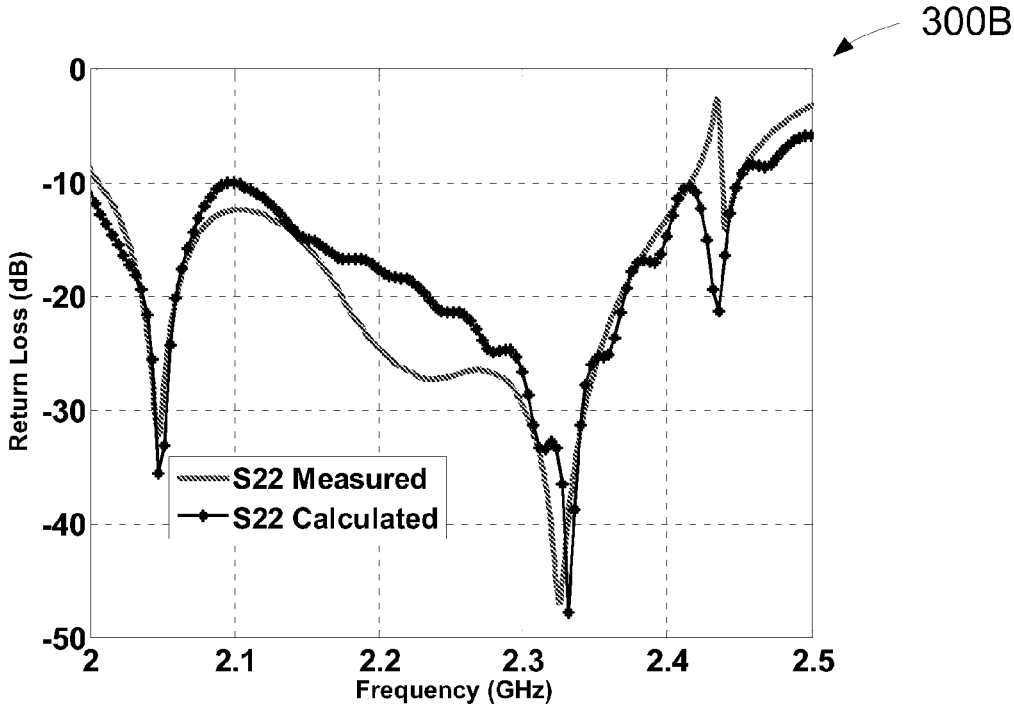
FIG. 3B is a graph of return loss versus frequency for port 2 of the narrowband cup waveguide antenna.
Figure 3C:
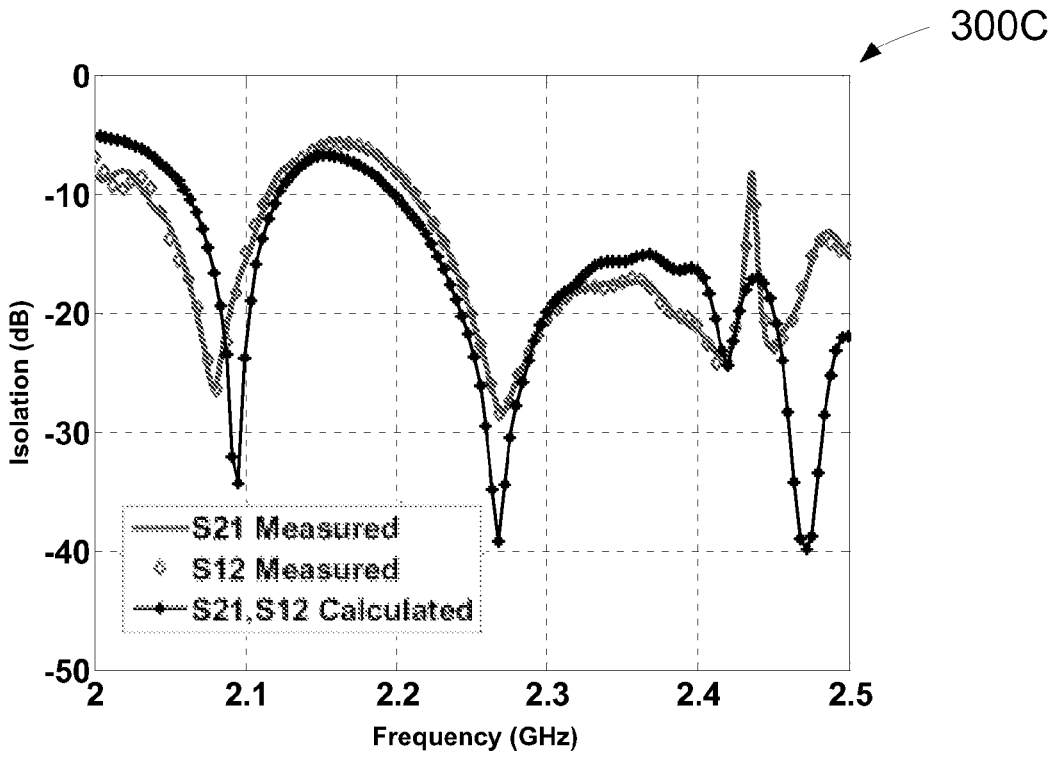
FIG. 3C is a graph of isolation versus frequency for ports 1 and 2 of the narrowband cup waveguide antenna.

FIG. 3A is a graph 300A of measured and simulated return loss versus frequency for port 1 of the narrowband cup waveguide antenna. FIG. 3B is a graph 300B of measured and simulated return loss versus frequency for port 2 of the narrowband cup waveguide antenna. FIGS. 3A and B show the measured and simulated return loss for ports 1 and 2 demonstrating both ports are within specification, to with, less than −20 dB at the center frequency of 2.25 GHz. FIG. 3C is a graph 300C of measured and simulated isolation versus frequency for ports 1 and 2 of the narrowband cup waveguide and indicates excellent agreement between measured and calculated data.

Figure 3D:
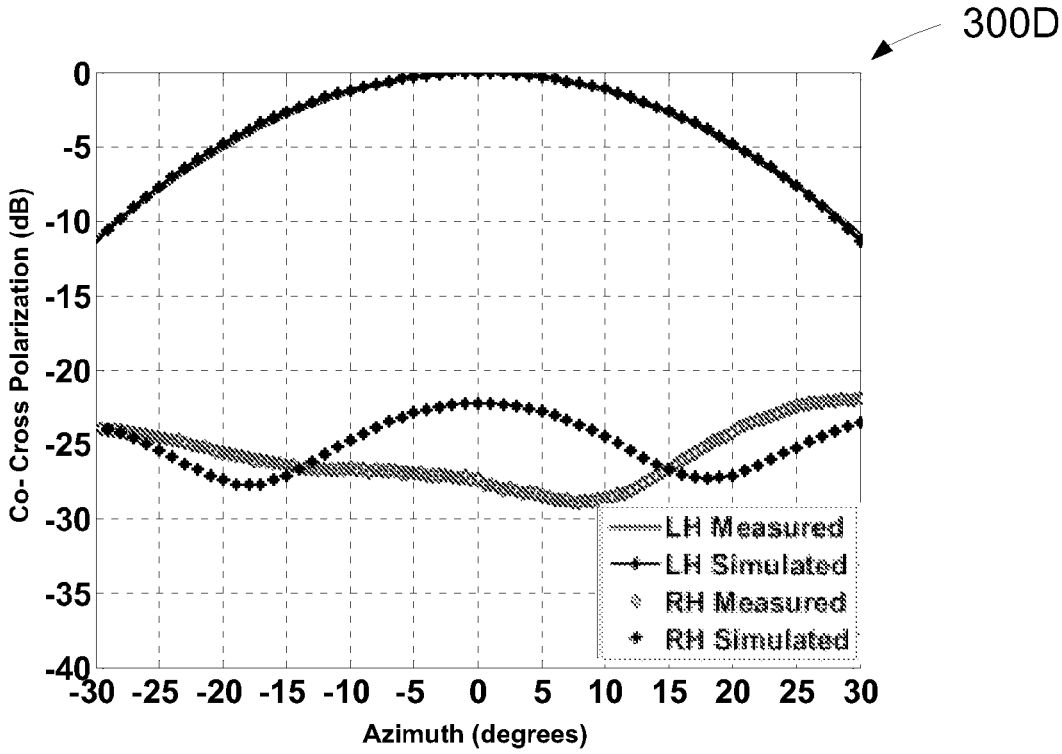
FIG. 3D is a graph of port 1 co- and cross-polarization versus Azimuth angle for the narrowband cup waveguide antenna at 2.25 GHz and phi of 90 degrees.

FIG. 3D is a graph 300D of waveguide port 1 co- and cross-polarization versus Azimuth angle for the narrowband cup waveguide antenna at 2.25 GHz. Excellent agreement was also obtained between measured and simulated farfield patterns. For example, FIGS. 3D-E and 3D-G show the co- and cross-polarization levels, and the axial ratios, respectively, for ports 1 and 2 at the center frequency in compliance with the design specifications. Axial ratio is used to describe the relationship between the magnitudes of the two orthogonal, linearly polarized electric field components in a circularly polarized wave. In a purely circularly polarized wave both electric field components have equal magnitude and the axial ratio will be unity. Axial ratio is an expression of the quality of the circular polarization. The axial ratio when expressed in units of dB is equal to 10 times the logarithm (base 10) of the axial ratio (ratio of the orthogonal electric field magnitudes). In addition, the measured far-field patterns show good agreement with simulation, and are within specification across the operating frequency band.

Figure 3E:
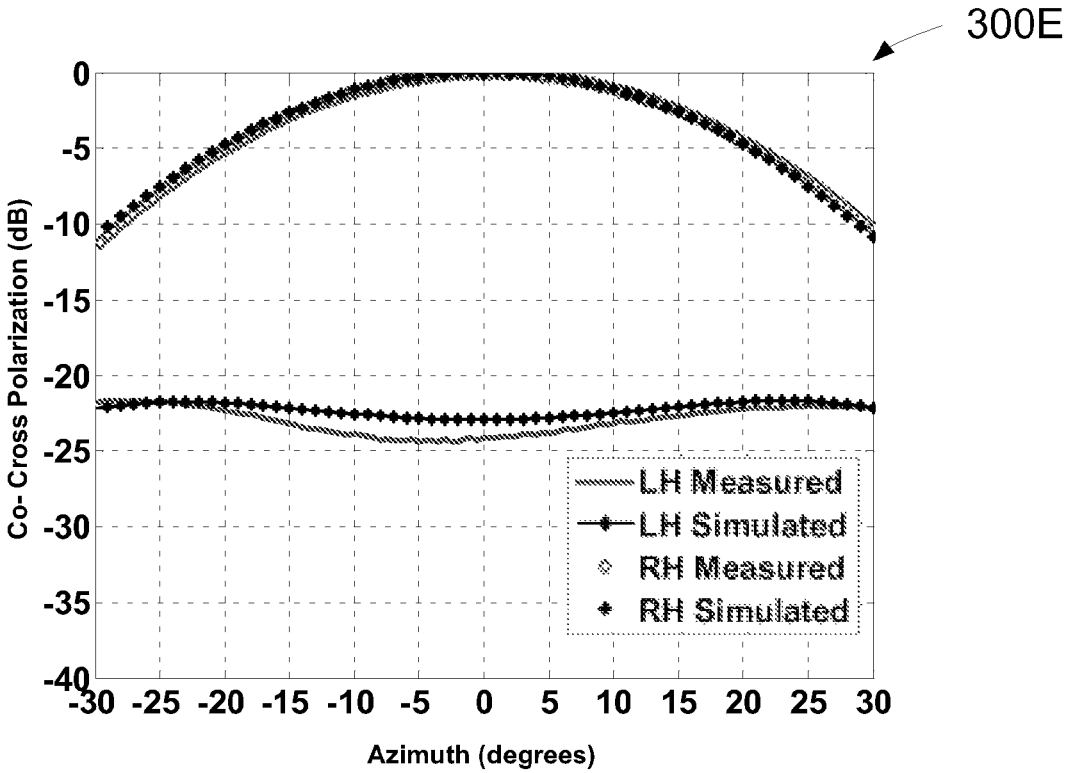
FIG. 3E is a graph of port 2 co- and cross-polarization versus Azimuth angle for the narrowband cup waveguide antenna at 2.25 GHz and phi of 90 degrees.
Figure 3F:
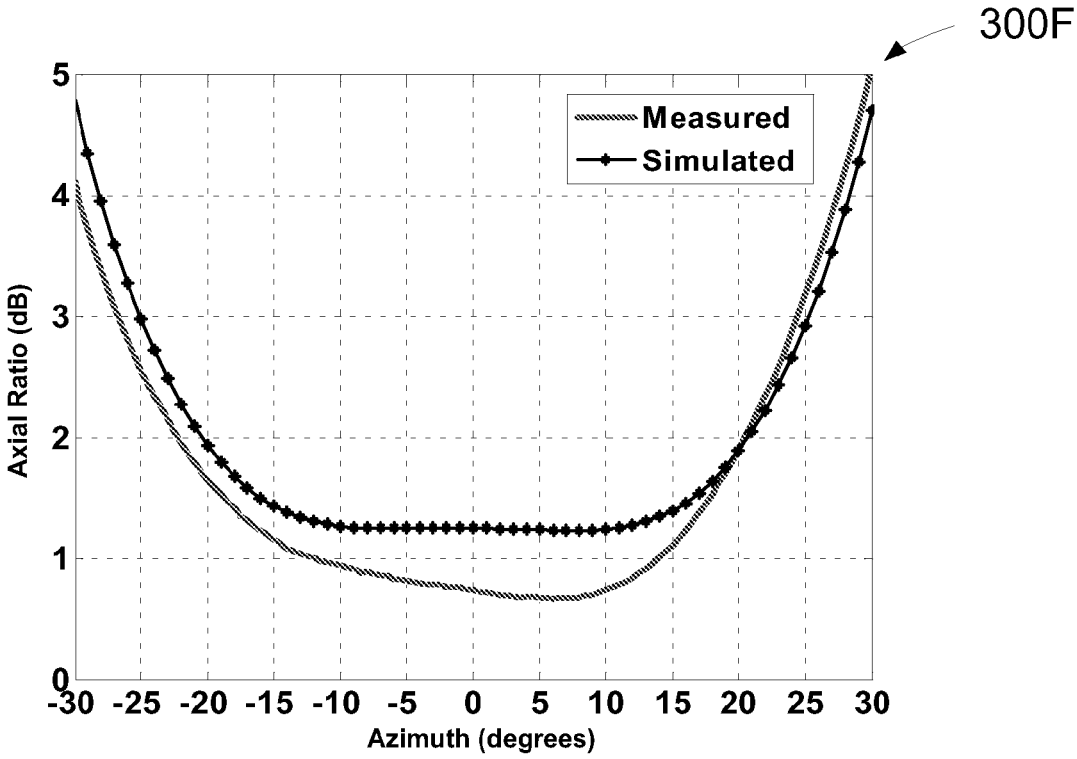
FIG. 3F is a graph of port 1 axial ratio versus Azimuth angle for the narrowband cup waveguide antenna at 2.25 GHz. and phi of 90 degrees
Figure 3G:
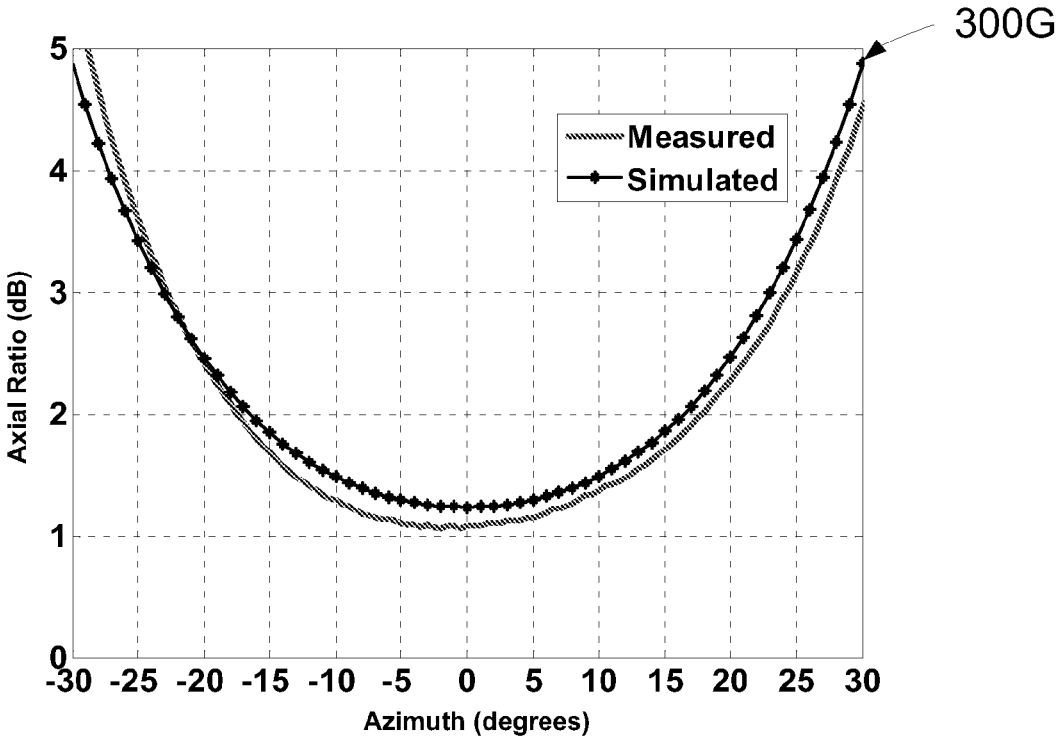
FIG. 3G is a graph of port 2 axial ratio versus Azimuth angle for the narrowband cup waveguide antenna at 2.25 GHz. and phi of 90 degrees

FIG. 3E is a graph 300E of port 2 co- and cross-polarization versus Azimuth angle for the narrowband cup waveguide antenna at 2.25 GHz. FIG. 3F is a graph 300F of port 1 axial ratio versus Azimuth angle for the narrowband cup waveguide antenna at 2.25 GHz indicating axial ratios of less than 5 dB at all angles and indicating measured axial ratios of less than 1 dB from about −15 to +15 degrees. Similarly, FIG. 3G is a graph 300G of port 2 axial ratio versus Azimuth angle for the narrowband cup waveguide antenna at 2.25 GHz indicating axial ratios of less than 5 dB at all angles and indicating measured axial ratios of less than about 1.5 dB from about 15 to +15 degrees.

FIG. 2H is a cross-sectional view 200H of the wideband conical cup waveguide antenna. Dimensions (in inches) of the wideband cup waveguide antenna, polarizer, and OMT are given below.

| | |
|---|---|
| Cylindrical waveguide 227 inner diameter | 3.670 |
| Cylindrical waveguide 227 outer diameter | 4.200 |
| Septum plate thickness, 235 | 0.0625 |
| Coax port pin 1 (237) and 2 (234) diameter | 0.036 |
| Polarizer screw/post diameter, 228, 229, 239 and three additional screws/posts not illustrated | 0.375 |
| Tuning screw 238 diameter | 0.164 |

Fabrication of the wideband cup cylindrical waveguide 227 was similar to the narrowband cup waveguide with the exception of the added tuning screw 238 in the OMT, the use of posts 228, 229 and 230 (plus three not illustrated) rather than screws for the polarizer section and the conical cup 240, 241 which was fabricated using computer numerical control (CNC) machining.

Tuning was performed by isolating sections of the assembly as follows. First, the cup 240 and subreflectors 245, 246 were removed. The polarizer posts 228, 229, 230 and three other posts arranged diametrically across the waveguide aperture were removed and their mounting holes were temporarily closed off flush to the inner surface of the waveguide using screws. Port pins 236, 234 were then tuned by comparing measured data with the simulation for the same configuration. The screws plugging the post holes were then removed and the machined to length polarizer posts 228, 229, 230 (and the three opposite posts) were simply put in place in there respective mounting holes through the waveguide wall. Return loss and isolation were measured and checked against simulated results. This was done to ensure that the assembly was achieving the expected performance at each level of assembly. Once good agreement was achieved for the return loss and isolation with all of the polarizer posts in place, the cup and subreflectors which form the backfire antenna were added to the assembly and the final S-parameter, radiation pattern and gain measurements were taken. The measured radiation patterns showed excellent agreement with simulation, and satisfy the specifications across the frequency bandwidth of 2.03-2.3 GHz.

The overall length of the wideband cup waveguide antenna is approximately 16.231 inches and the cup diameter is approximately 12.150 inches. The tuning screw 238 is approximately 2.41 inches from the end plate 231 and it is locked in place with a nut 239. The wall thickness of the circular waveguide used in the wideband application is 0.265 inches thick and includes threads therein for the interengagement with threads on the tuning screw 238.

Subreflector 246 is approximately 2.186 inches in diameter and subreflector 245 is approximately 2.548 inches in diameter. Both subreflectors are supported by EPS 244. Subreflector 246 is the datum line and is referenced as zero inches into the antenna when reference is made from right to left viewing FIG. 2H. Subreflector 245 is spaced apart from subreflector 246 approximately 0.471 inches. The upper lip or beginning of the cylindrical waveguide is approximately 2.831 inches leftwardly from subreflector 246. Cup 240 begins to gradually curve approximately 3.376 inches from subreflector 246 until it meets conical section 241 of the cup which is affixed to the mounting ring 242. The wideband cup 240 includes a conical or frustum-conical section 241 which is tapered and is secured with screws to the mounting ring 242 approximately 4.741 inches from the subreflector 246. Cylindrical waveguide 227 extends approximately 1.91 inches into the waveguide cup.

The first 230 and third 228 polarizer posts can be referred to as the outside polarizer posts and they protrude radially inwardly into the cylindrical waveguide approximately 0.710 inches. The middle or second polarizer post 229 protrudes radially into the cylindrical waveguide approximately 0.860 inches. The polarizer posts are secured with adhesive or some other type of mechanical affixation. The first polarizer post 230 resides 5.331 inches from subreflector 246, the second polarizer post 229 resides approximately 7.031 inches from subreflector 246 and the third polarizer post 228 resides approximately 8.731 inches from subreflector 246.

Still referring to FIG. 2H, first pin 237 may or may not include a short sheath of dielectric material 236 therearound as previously described in connection with the narrowband cup waveguide antenna described above in FIGS. 2-2G. First pin 237 resides 10.631 inches from the subreflector 246. Septum plate 235 is one inch in longitudinal extent, 0.0625 inches thick, and resides at its beginning or leading edge 12.256 inches from subreflector 246. Septum plate 235 acts as a back short to first pin 237 and is aligned therewith. Adjusting screw 238 is 0.164 inches in diameter and resides 13.821 inches from subreflector 246 and primarily tunes in a vernier fashion second pin 234. First and second pins 237, 234 are common with the center conductors of coaxial cables and are secured with an SMA connector (shown for port 2 only as 233 and mounting block arrangement 232) as described above. End cap 231 is cylindrical and is secured to cylindrical waveguide 227 using a force fit.

Figure 4A:
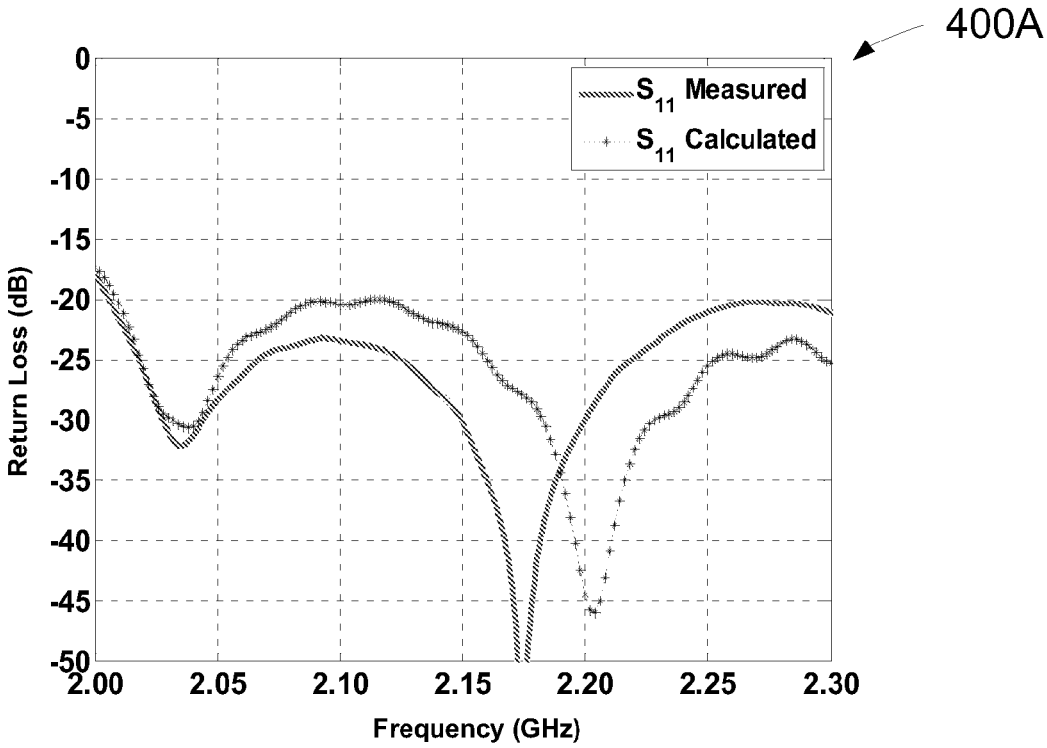
FIG. 4A is a graph of port 1 return loss versus frequency for the wideband cup waveguide antenna.
Figure 4B:
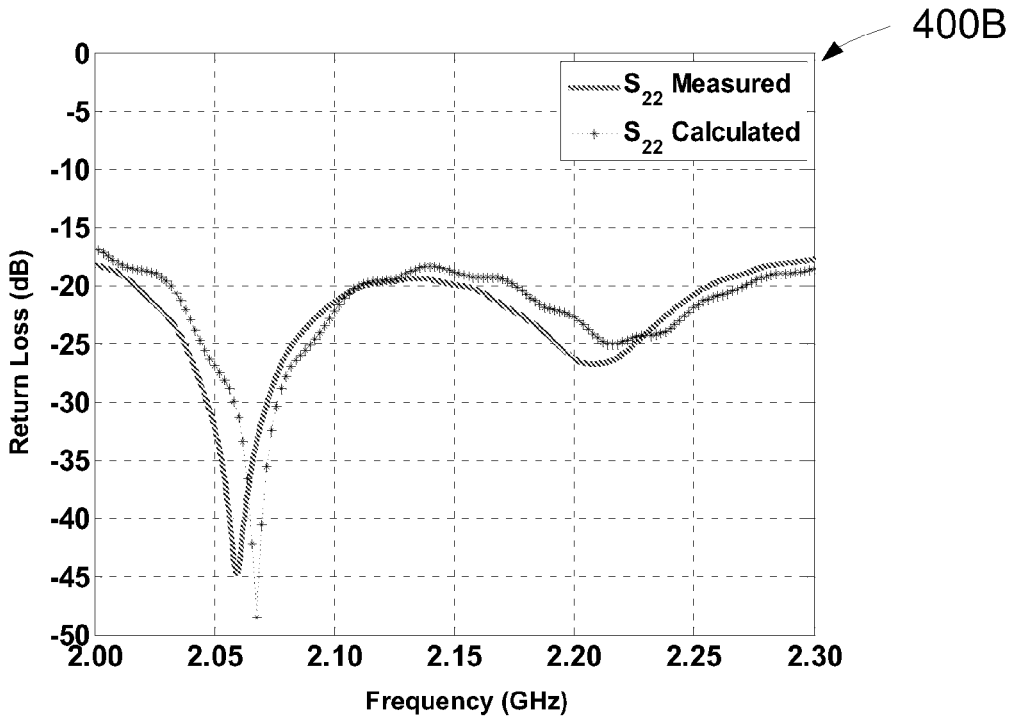
FIG. 4B is a graph of port 2 return loss versus frequency for the wideband cup waveguide antenna.
Figure 4C:
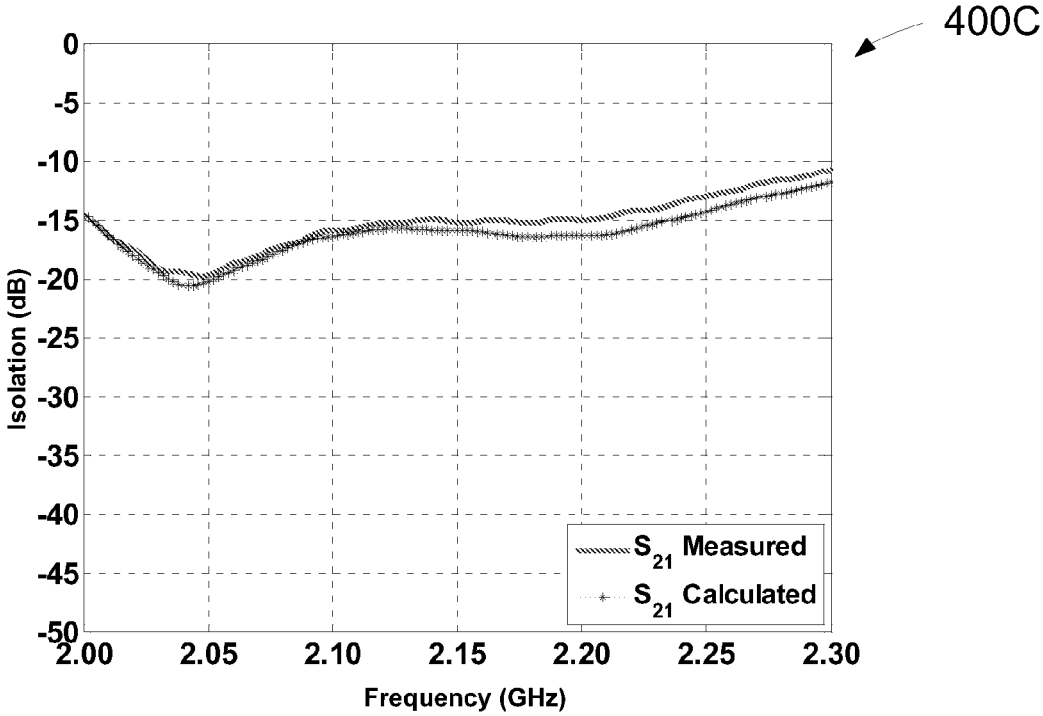
FIG. 4C is a graph of ports 1 and 2 isolation versus frequency for the wideband cup waveguide antenna.

FIG. 4A is a graph 400A of port 1 return loss versus frequency for the wideband cup waveguide antenna. FIG. 4B is a graph 400B of port 2 return loss versus frequency for the wideband cup waveguide antenna. FIGS. 4A and 4B compare the measured and simulated return loss, respectively, and the agreement is very good with the port 2 return loss just slightly exceeding the specified goal of −20 dB at about 2.3 GHz. FIG. 4C is a graph 400C of ports 1 and 2 isolation versus frequency for the wideband cup waveguide antenna.

Figure 4D:
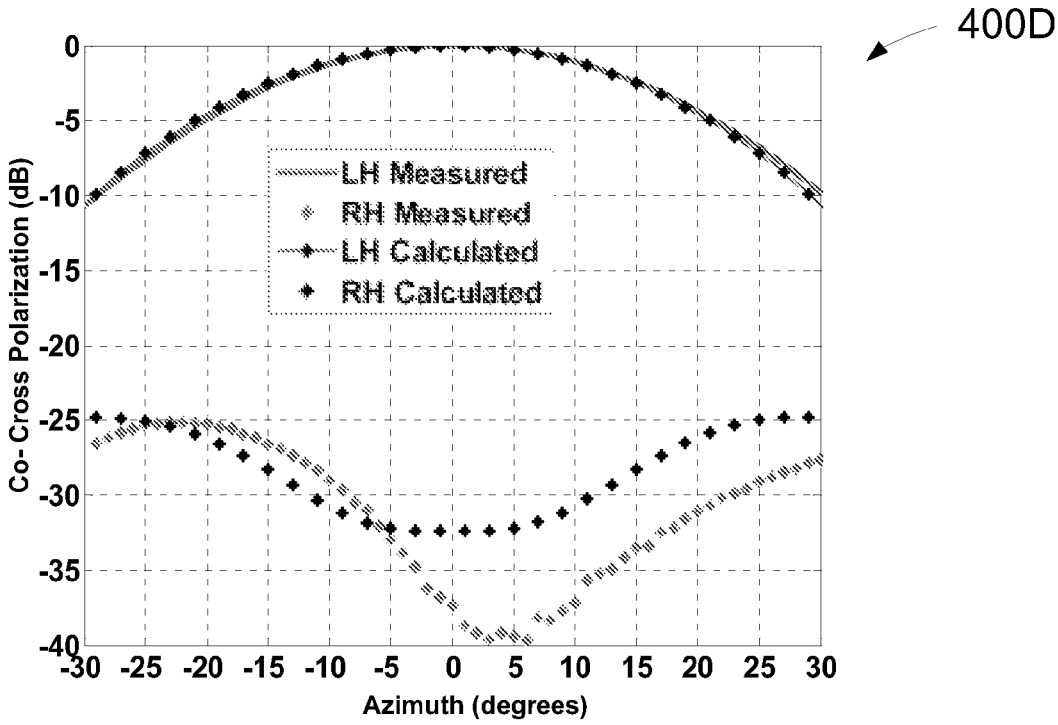
FIG. 4D is a graph of port 1 co- and cross-polarization versus Azimuth angle for the wideband cup waveguide antenna at 2.07175 GHz and phi of 0 degrees.
Figure 4E:
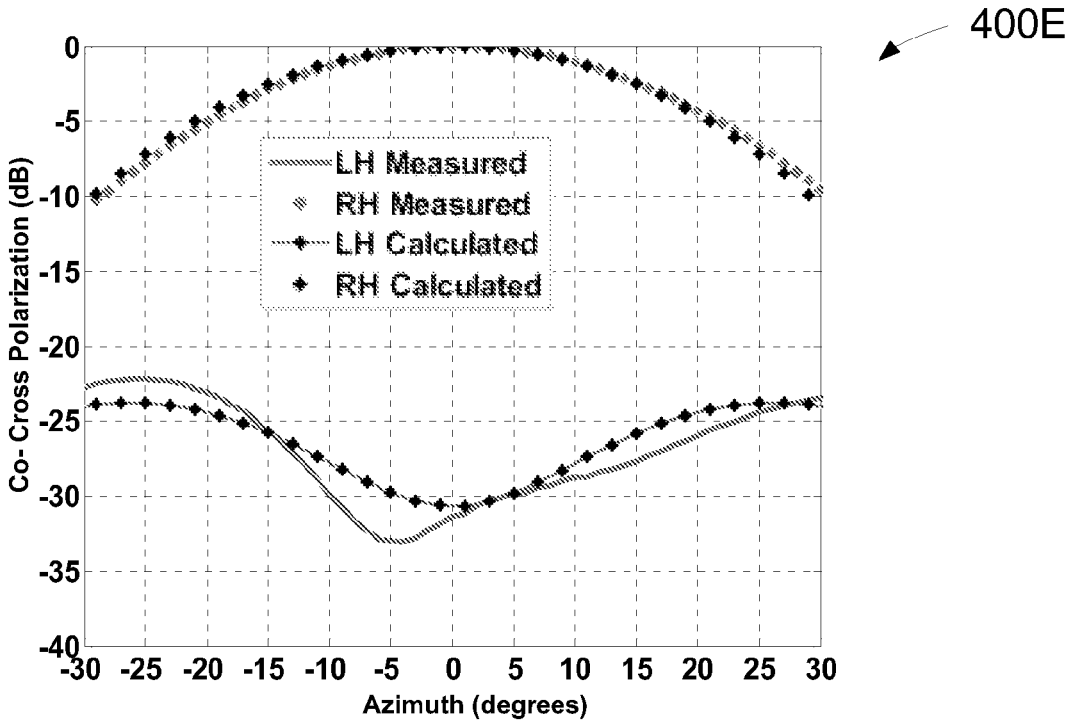
FIG. 4E is a graph of port 2 co- and cross-polarization versus Azimuth angle for the wideband cup waveguide antenna at 2.07175 GHz and phi of 0 degrees.

FIG. 4D is a graph 400D of port 1 co- and cross-polarization versus Azimuth angle for the wideband cup waveguide antenna at 2.07175 GHz. FIG. 4E is a graph 400E of port 2 co- and cross-polarization versus Azimuth angle for the wideband cup waveguide antenna at 2.07175 GHz.

Figure 4F:
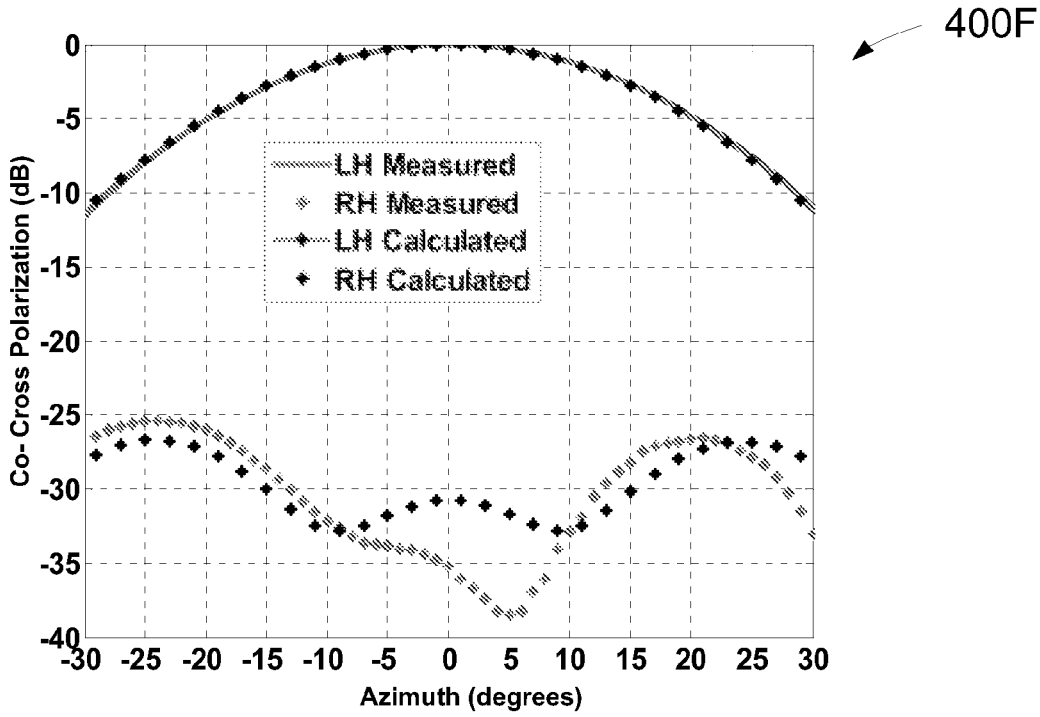
FIG. 4F is a graph of port 1 co- and cross-polarization versus Azimuth angle for the wideband cup waveguide antenna at 2.25 GHz and phi of 0 degrees.
Figure 4G:
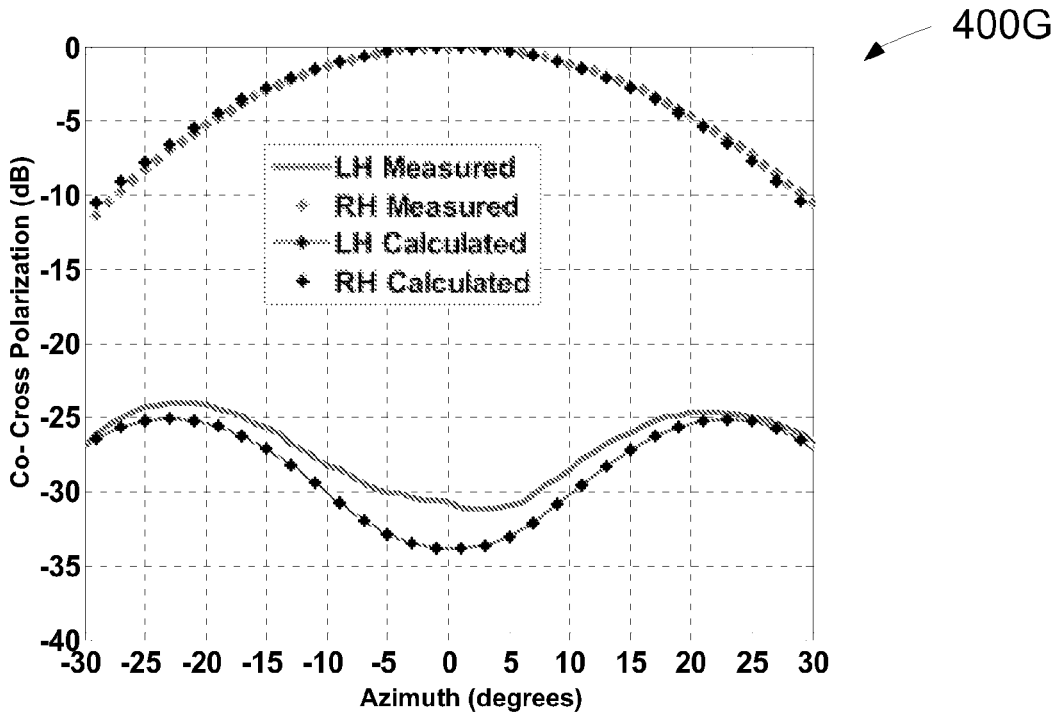
FIG. 4G is a graph of port 2 co- and cross-polarization versus Azimuth angle for the wideband cup waveguide antenna at 2.25 GHz and phi of 0 degrees.

FIG. 4F is a graph 400F of port 1 co- and cross-polarization versus Azimuth angle for the wideband cup waveguide antenna at 2.25 GHz. FIG. 4G is a graph 400G of port 2 co- and cross-polarization versus Azimuth angle for the wideband cup waveguide antenna at 2.25 GHz.

Figure 4H:
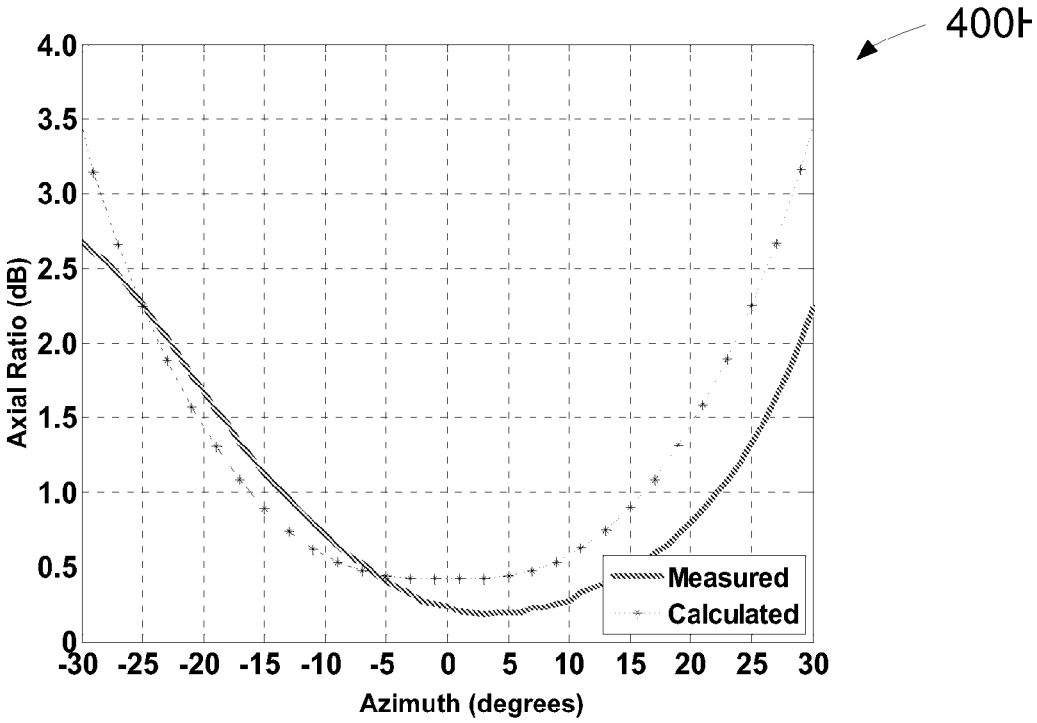
FIG. 4H is a graph of port 1 axial ratio versus Azimuth angle for the wideband cup waveguide antenna at 2.07175 GHz and phi of 0 degrees.
Figure 4I:
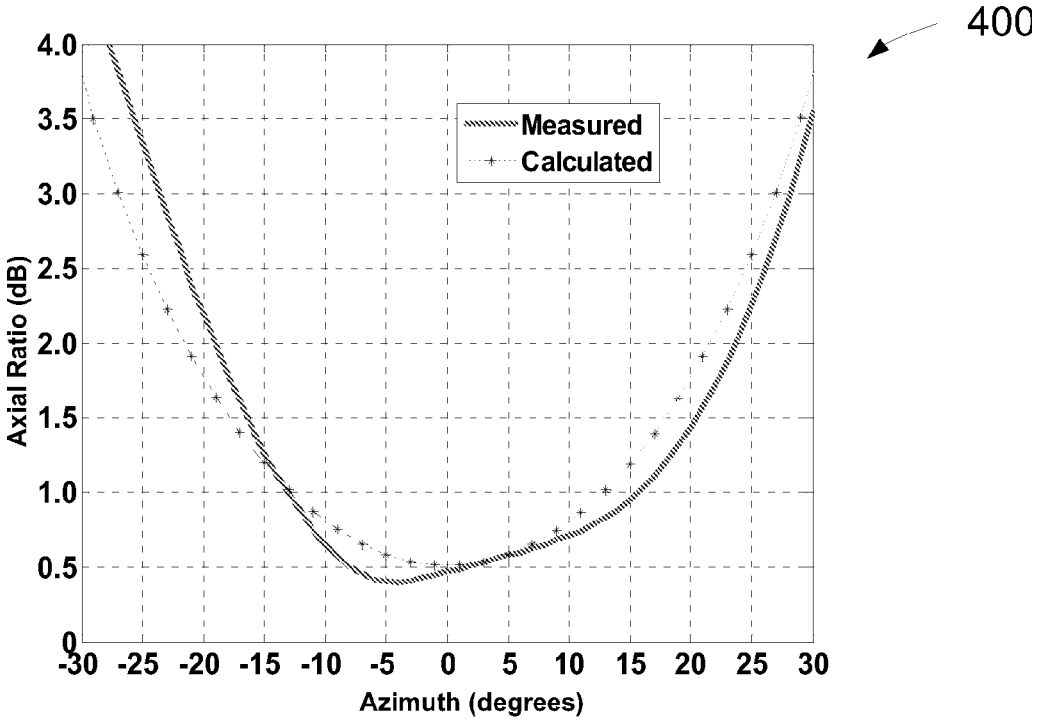
FIG. 4I is a graph of port 2 axial ratio versus Azimuth angle for the wideband cup waveguide antenna at 2.07175 GHz and phi of 0 degrees.
Figure 4J:
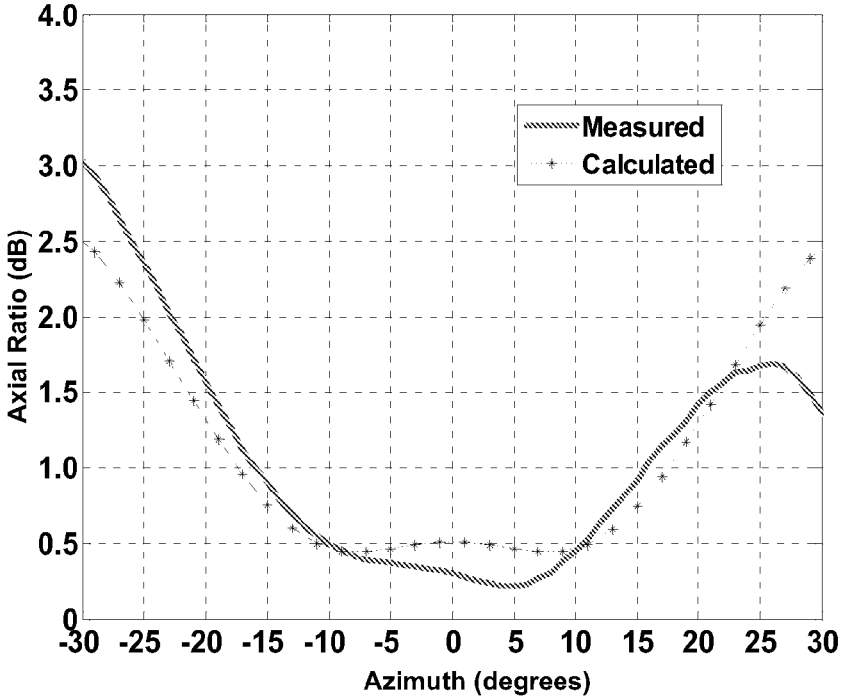
FIG. 4J is a graph of port 1 axial ratio versus Azimuth angle for the wideband cup waveguide antenna at 2.25 GHz and phi of 0 degrees.
Figure 4K:
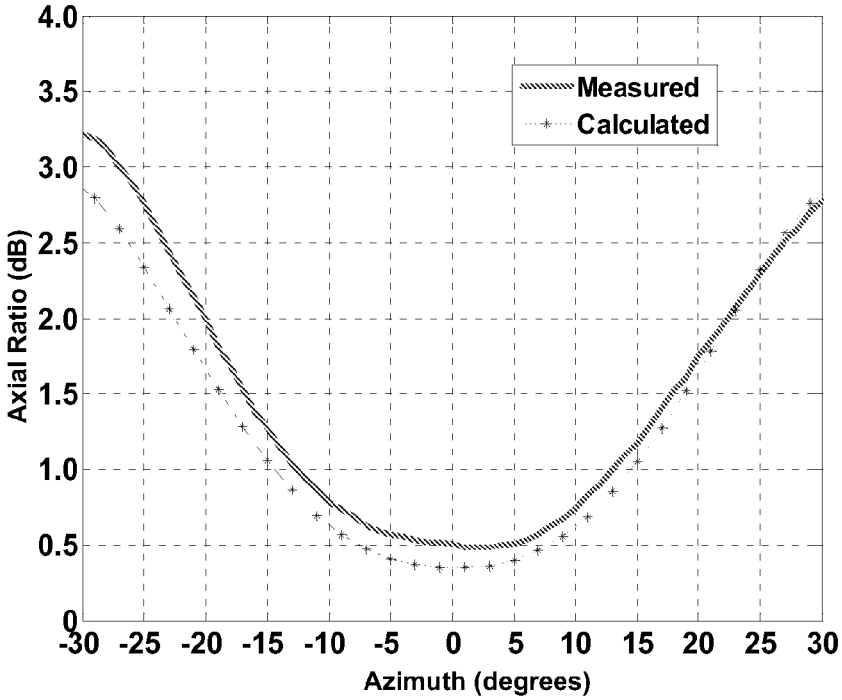
FIG. 4K is a graph of port 2 axial ratio versus Azimuth angle for the wideband cup waveguide antenna at 2.25 GHz and phi of 0 degrees.

FIG. 4H is a graph 400H of port 1 axial ratio versus Azimuth angle for the wideband cup waveguide antenna at 2.07175 GHz. FIG. 4I is a graph 400I of port 2 axial ratio versus Azimuth angle for the wideband cup waveguide antenna at 2.07175 GHz. FIG. 4J is a graph 400J of port 1 axial ratio versus Azimuth angle for the wideband cup waveguide antenna at 2.25 GHz. FIG. 4K is a graph of port 2 axial ratio versus Azimuth angle for the wideband cup waveguide antenna at 2.25 GHz.

FIG. 2I is a cross-sectional view 200I of corrugated horn 260 waveguide antenna. Stepped corrugations 261 are arranged on the inner circumference as illustrated in FIG. 2I. The corrugated horn antenna was designed using a method of moments code for rotationally symmetric feeds. The OMT and polarizer dimensions are similar with some variation to that described above for the narrowband cup waveguide. Compare with FIGS. 2-2G wherein slightly different pin depths and slightly different nominal polarizer screw depths are used. It should be kept in mind that the polarizer screw depths stated in connection with the narrowband cup waveguide antenna, the wideband cup waveguide antenna and the corrugated horn antenna are nominal and will in fact vary when tuned. See FIG. 2I where screw 217 is illustrated as being inserted relatively less than screws 216 and 218.

Dimensions (inches) of the corrugated horn antenna 260, polarizer 212-214 and 216-218, and OMT are given below.

| | |
|---|---|
| Cylindrical waveguide inner diameter, 201 | 3.614 |
| Cylindrical waveguide outer diameter, 201 | 3.801 |
| Septum thickness, 211 | 0.0625 |
| Coax port pin 1 depth into waveguide, 226 | 1.175 |
| Coax port pin 2 depth into waveguide, 224 | 1.175 |
| Polarizer screw depth into waveguide | 0.75 |
| Polarizer screw diameter, 212, 213, 214, 216, 217, 218 | 0.375 |
| Coax center pin diameter, 226, 224 | 0.036 |

Flange 262 of horn 260 is affixed by screws 248 to mounting ring 247 which in turn is affixed to waveguide 201.

The fabrication complexity of the corrugated horn waveguide antenna is somewhat more complex than the narrowband and wideband cup waveguide antennas because of the machining of the horn corrugations. However, assembly was straightforward requiring only a flange connection between the horn and the OMT/polarizer. Tuning was also straightforward requiring only minor adjustments to the polarizer screws and the coaxial pins.

Figure 5A:
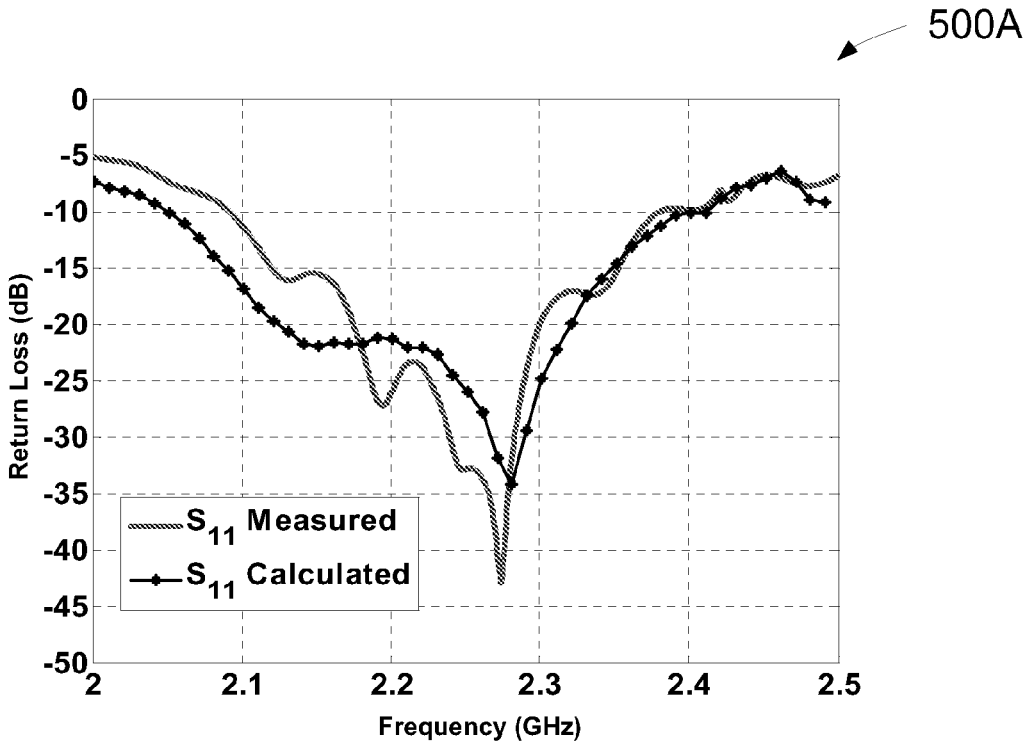
FIG. 5A is a graph of port 1 return loss versus frequency of the corrugated horn waveguide antenna.
Figure 5B:
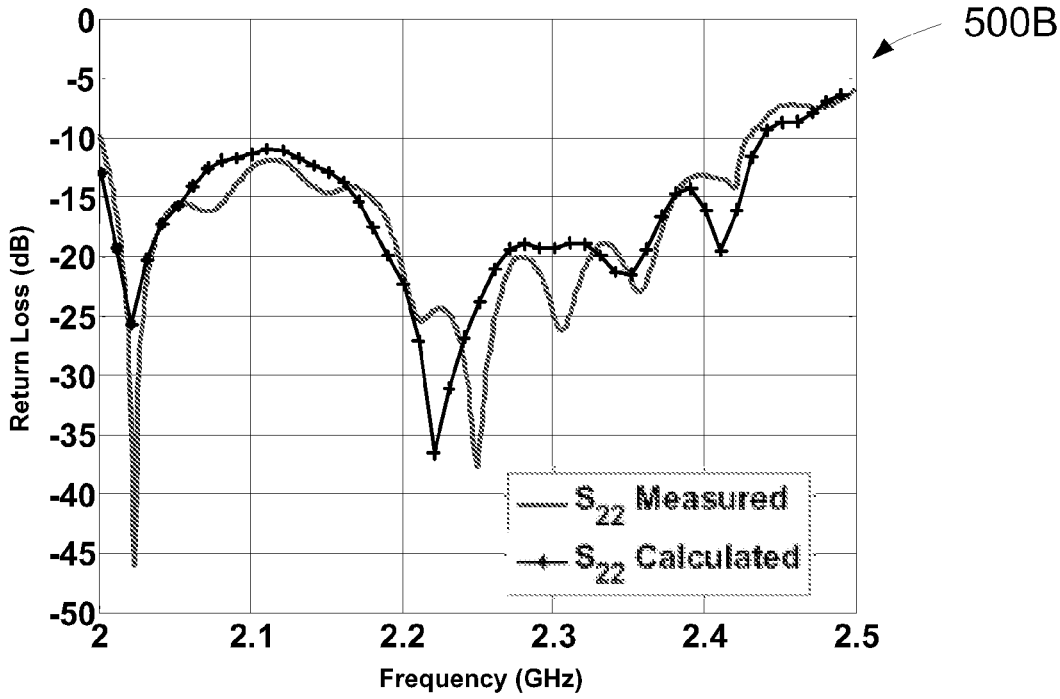
FIG. 5B is a graph of port 2 return loss versus frequency of the corrugated horn waveguide antenna.

FIG. 5A is a graph 500A of port 1 return loss versus frequency of the corrugated horn waveguide antenna. FIG. 5B is a graph 500B of port 2 return loss versus frequency of the corrugated horn waveguide antenna.

Figure 5C:
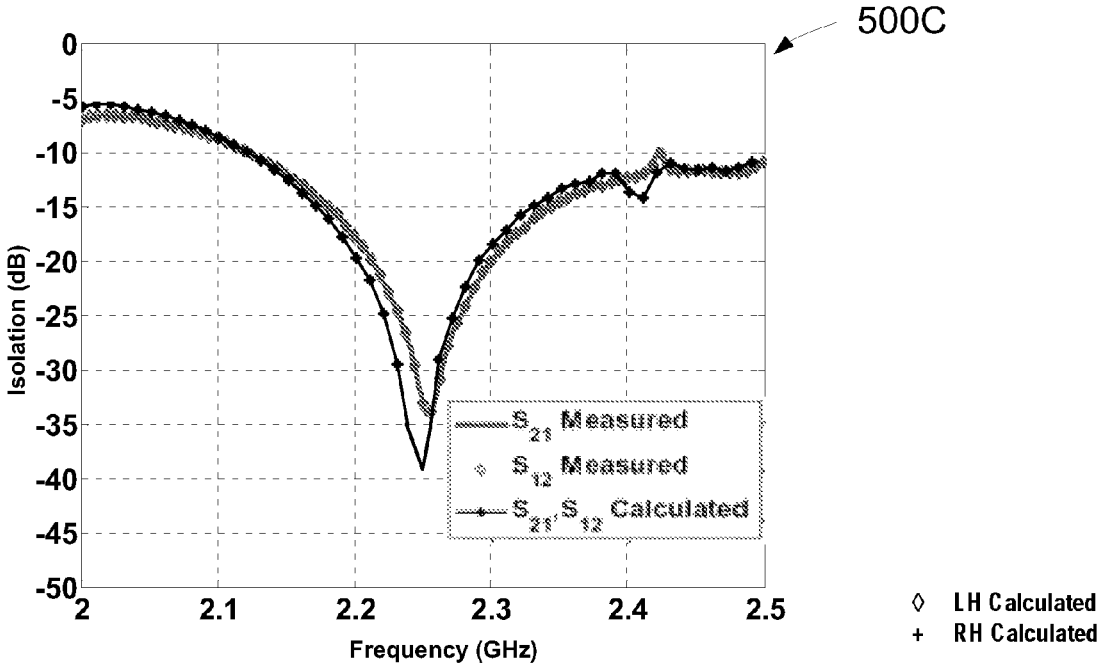
FIG. 5C is a graph of ports 1 and 2 isolation versus frequency for the corrugated horn waveguide antenna.

FIG. 5C is a graph 500C ports 1 and 2 measured and simulated isolation versus frequency for the corrugated horn waveguide antenna. The results easily meet the specifications for both ports with the return loss being less than −20 dB at both ports for the frequency of interest, to with, 2.2-2.3 GHz. Further, the isolation for both ports is less than −10 dB.

Figure 5D:
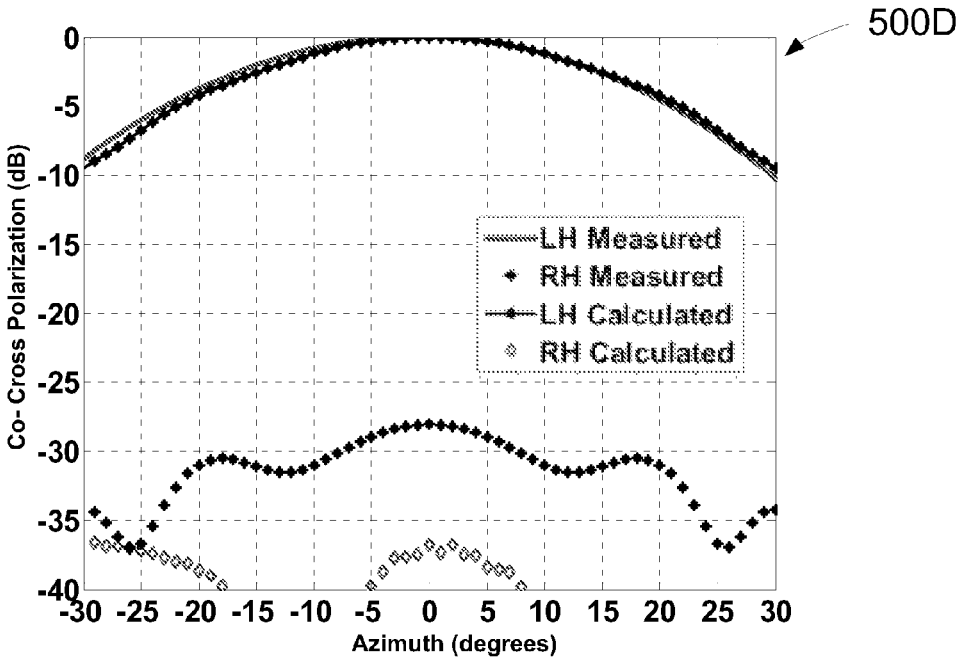
FIG. 5D is a graph of port 1 co- and cross-polarization for the corrugated horn waveguide antenna at 2.25 GHz and phi of 0 degrees.
Figure 5E:
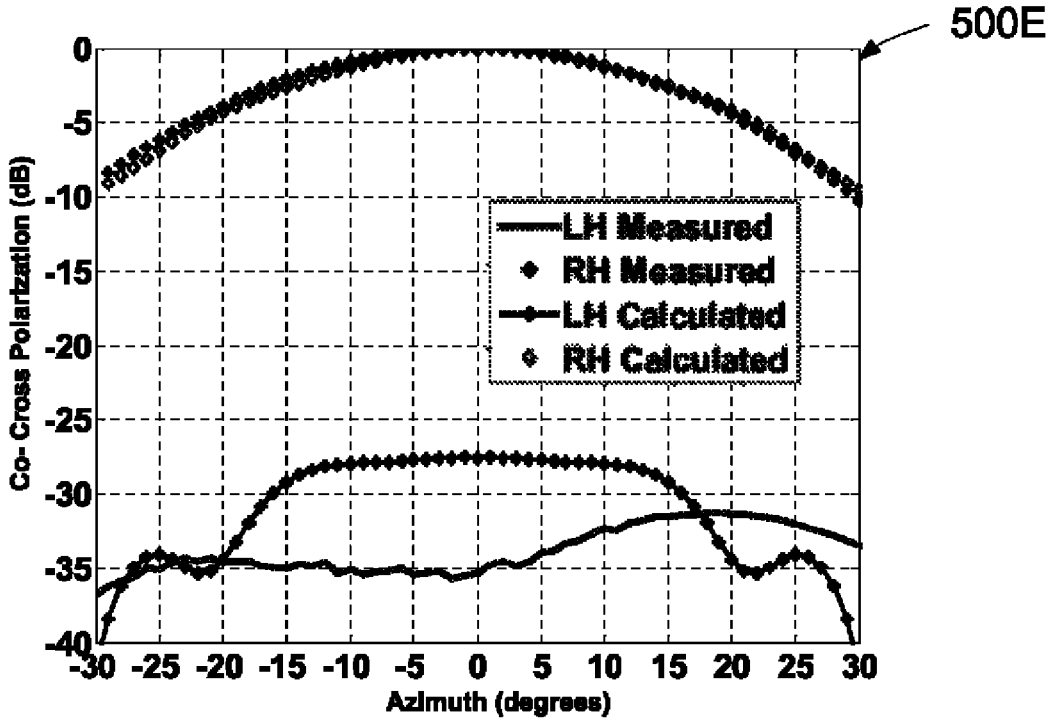
FIG. 5E is a graph of port 2 co- and cross-polarization for the corrugated horn waveguide antenna at 2.25 GHz and phi of 0 degrees.

FIG. 5D is a graph 500D of port 1 measured and simulated co- and cross-polarization versus Azimuth angle for the corrugated horn waveguide antenna at 2.25 GHz. FIG. 5E is a graph 500E of port 2 measured and simulated co- and cross-polarization versus Azimuth angle for the corrugated horn waveguide antenna at 2.25 GHz.

Figure 5F:
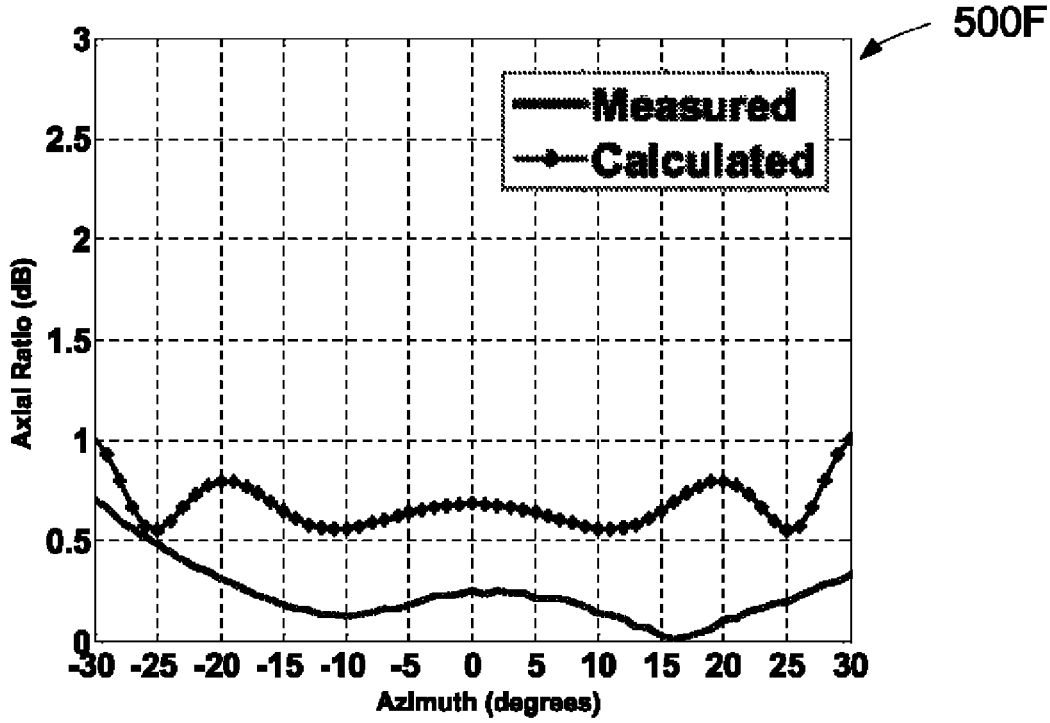
FIG. 5F is a graph of port 1 axial ratio versus Azimuth angle for the corrugated horn waveguide antenna at 2.25 GHz and phi of 0 degrees.
Figure 5G:
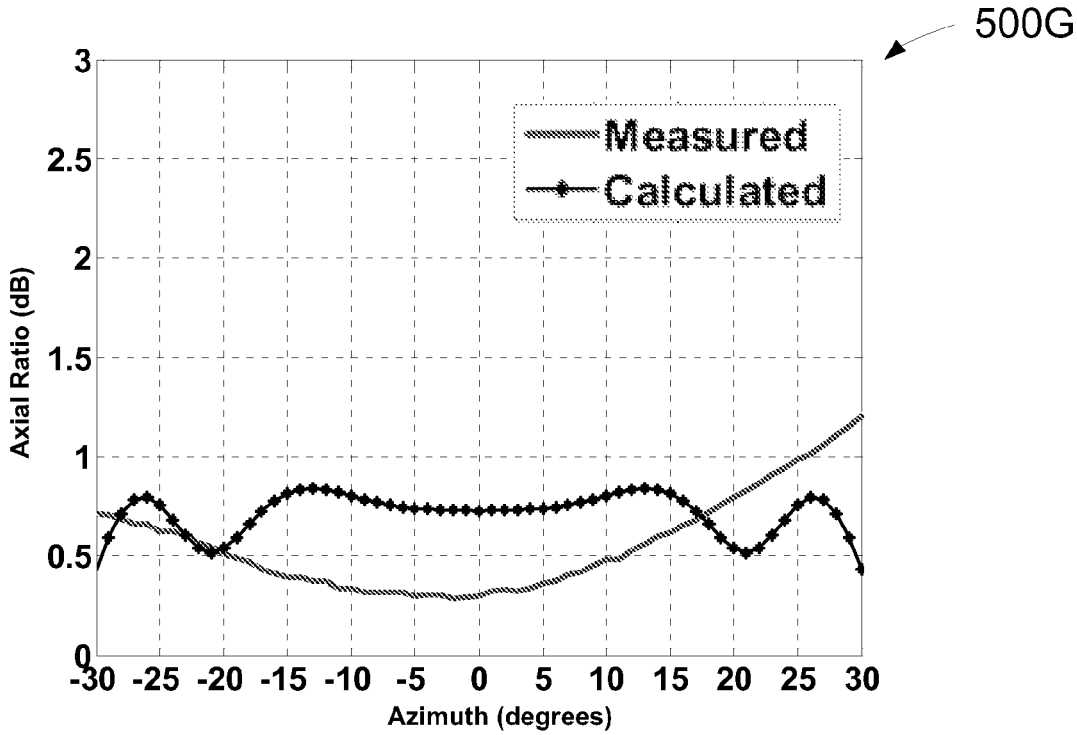
FIG. 5G is a graph of port 2 axial ratio versus Azimuth angle for the corrugated horn waveguide antenna at 2.25 GHz and phi of 0 degrees.

FIG. 5F is a graph 500F of port 1 measured and simulated axial ratio versus Azimuth angle for the corrugated horn waveguide antenna at 2.25 GHz. FIG. 5G is a graph 500G of port 2 measured and simulated axial ratio versus Azimuth angle for the corrugated horn waveguide antenna at 2.25 GHz. FIGS. 5F and 5G show the measured and simulated axial ratios, which again show very good agreement. The graphs show data at the center frequency. However, the corrugated horn waveguide antenna met the specifications for directivity and axial ratio across the bandwidth of 2.2-2.3 GHz.

LIST OF REFERENCE NUMERALS

100—schematic view of tracking and data relay satellite (TDRS)

101—32 element multiple access antenna

200—narrowband cup waveguide antenna
200A—left front perspective view of narrowband cup waveguide antenna
200B—left side view of narrowband cup waveguide antenna
200C—right side view of narrowband cup waveguide antenna
200D—partial cross-sectional view of narrowband cup waveguide antenna taken along the lines 2D-2D of FIGS. 2 and 2A
200E—partial cross-sectional view of narrowband cup waveguide antenna taken along the lines 2E-2E of FIGS. 2 and 2A
200F—top view of the narrowband cup waveguide antenna
200G—right rear perspective view of the narrowband cup waveguide antenna
200H—cross-sectional view of wideband conical cup waveguide antenna
200I—cross-sectional view of corrugated horn waveguide antenna
200W—cross-sectional view of the waveguide taken along the lines 2W-2W of FIG. 2B
201—waveguide
202—narrowband cup
202A, 247—mounting ring
202B—set screw of mounting ring
203—support
204—strap of support
205, 244—EPS (expandable polystyrene) support
206, 245, 246—subreflector
207—cup reflector
208—waveguide end cap
208S—inner portion of waveguide end cap
209—coaxial connector pin/port 2
210—mount for coaxial connector pin/port 2
211—septum plate
212, 213, 214, 216, 217, 218—adjustable threaded post
212A, 213A, 214A, 216A, 217A, 218A—lock nuts for threaded posts
215, 219—mounting block for screws/posts
220, 248—waveguide to cup/horn screws
221—coaxial connector for pin/port 1
222—mount for coaxial connector pin/port 1
223—dielectric sheath on coax pin/port 2
224—coax port 2 pin/probe
225—dielectric sheath on coax pin/port 1
226—coax port 1 pin/probe
227—waveguide for wideband
228, 230—relatively shorter posts
229—relatively longer post
231—end plate
232—mounting block for port 2
233—coaxial connector for port 2
234—coax port 2 pin/probe
235—septum
236—dielectric sheath for port/pin 1
237—coax port 1 pin/probe
238—tuning screw for port 2
239—lock nut
240—wideband cup
241—frusto-conical portion of wideband cup
242—mounting ring
243—screws affixing wideband cup to ring
244—EPS
245—sub reflector
246—sub reflector
247—mounting ring
248—screws
260—corrugated horn
261—corrugation
262—flange
300A—narrowband cup waveguide antenna port 1 graph of return loss versus frequency
300B—narrowband cup waveguide antenna port 2 graph of return loss versus frequency
300C—narrowband cup waveguide antenna ports 1 and 2 graph of isolation versus frequency
300D—narrowband cup waveguide antenna port 1 co and cross-polarization versus Azimuth angle at 2.25 GHz
300E—narrowband cup waveguide antenna port 2 co- and cross-polarization versus Azimuth angle at 2.25 GHz
300F—narrowband cup waveguide antenna port 1 axial ratio versus Azimuth angle at 2.25 GHz.
300G—narrowband cup waveguide antenna port 2 axial ratio versus Azimuth angle at 2.25 GHz
400A—wideband cup waveguide antenna port 1 graph of return loss versus frequency
400B—wideband cup waveguide antenna port 2 graph of return loss versus frequency
400C—wideband cup waveguide antenna ports 1 and 2 graph of isolation versus frequency
400D—wideband cup waveguide antenna port 1 co- and cross-polarization versus Azimuth angle at 2.07175 GHz
400E—wideband cup waveguide antenna port 2 co- and cross-polarization versus Azimuth angle at 2.07175 GHz
400F—wideband cup waveguide antenna port 1 co- and cross-polarization versus Azimuth angle at 2.25 GHz
400G—wideband cup waveguide antenna port 2 co- and cross-polarization versus Azimuth angle at 2.25 GHz
400H—wideband cup waveguide antenna port 1 axial ratio versus Azimuth angle at 2.07175 GHz
400I—wideband cup waveguide antenna port 2 axial ratio versus Azimuth angle at 2.07175 GHz
400J—wideband cup waveguide antenna port 1 axial ratio versus Azimuth angle at 2.25 GHz
400K—wideband cup waveguide antenna port 2 axial ratio versus Azimuth angle at 2.25 GHz
500A—corrugated horn waveguide antenna port 1 graph of return loss versus frequency
500B—corrugated horn waveguide antenna port 2 graph of return loss versus frequency
500C—corrugated horn waveguide antenna ports 1 and 2 graph of isolation versus frequency
500D—corrugated horn waveguide antenna port 1 co- and cross-polarization versus Azimuth angle at 2.25 GHz
500E—corrugated horn waveguide antenna port 2 co- and cross-polarization versus Azimuth angle at 2.25 GHz
500F—corrugated horn waveguide antenna port 1 axial ratio versus Azimuth angle
500G—corrugated horn waveguide antenna port 2 axial ratio versus Azimuth angle Those skilled in the art will readily recognize that the invention has been set forth by way of example only and that many changes may be made to the invention without departing from the spirit and scope of the claims which follow hereinbelow.

We claim:

1. A process for tuning an antenna for optimizing the simultaneous propagation and/or reception of dual circularly polarized electromagnetic waves, said antenna includes a cylindrical waveguide having an orthomode transducer forming first and second ports with first and second pins therein oriented orthogonally with each other, a septum intermediate said first pin and said second pin and aligned with said first in within said cylindrical waveguide and residing in proximity thereto, and a polarizer mechanism having six radially oriented screws, comprising the steps of:

simultaneously applying left hand circular polarized electromagnetic waves and right hand circular polarized electromagnetic waves to said antenna;

measuring the response of said first and second pins of said orthomode transducer to said respective left hand and right hand circular polarized electromagnetic waves, said second pin residing in proximity to a closed end of said cylindrical waveguide and said first pin residing distally with respect to said closed end of said cylindrical waveguide;

adjusting the polarizer mechanism of said antenna to simultaneously improve said respective responses of said first and second pins, said polarizer mechanism resides between said first pin and an open end of said cylindrical waveguide, said adjustment of said polarizer mechanism includes varying the insertion depth of said screws within said polarizer mechanism;

repeating said measuring and adjusting steps until said respective responses are simultaneously optimized.

2. The process for tuning an antenna for optimizing the simultaneous propagation and/or reception of dual circularly polarized electromagnetic waves, said antenna includes a cylindrical waveguide having an orthomode transducer forming first and second ports with first and second pins therein as claimed in claim 1, wherein said polarizer mechanism of said antenna includes adjustable screws and further comprising the steps of: replacing said screws with posts fixed within said waveguide; fine tuning said waveguide with another adjustable screw once said posts are fixed in place; and, coupling said waveguide to a short backfire mechanism.

3. An antenna, comprising:

a cylindrical waveguide, said cylindrical waveguide includes:

a closed end, an open end and a longitudinal axis;

an interior and an exterior;

a first pin or port, and a second pin or port;

said second pin resides in proximity to said closed end of said cylindrical waveguide, said second pin extending radially into said interior of said cylindrical wave guide;

said first pin of said cylindrical waveguide longitudinally spaced distally apart from said closed end of said cylindrical waveguide, said first pin extending radially into said interior of said cylindrical waveguide;

said first pin and said second pin residing orthogonally to each other forming a pair of longitudinally spaced apart orthogonal pins;

a septum intermediate said first pin and said second pin; said septum aligned with said first pin within said cylindrical waveguide and residing in proximity thereto;

a polarization mechanism including six radially oriented screws or ports extending from said exterior to said interior of said waveguide; and, said polarization mechanism residing between said first pin and said open end of said cylindrical waveguide.

4. The antenna as claimed in claim 3, wherein three of said six screws or posts are arranged 180° from the other three of said six radially oriented screws or posts, three of said screws or posts are arranged at an angle of 45° with respect to one of said pins, and, said other three of said six radially oriented screws or posts are arranged at an angle of 45° with respect to said other pin.

5. The antenna as claimed in claim 4 further comprising: a cup, said cup includes a frustum-conically shaped reflector base; a subreflector; said cup affixed to said open end of said waveguide; and, said subreflector separated apart from said reflector.

6. An antenna as claimed in claim 4 further comprising a corrugated horn affixed to said waveguide.

7. The antenna as claimed in claim 3, further comprising a radially oriented screw or post residing in proximity to said second pin, and, said radially oriented screw fine tunes the performance of said second pin.

8. The antenna as claimed in claim 3, further comprising a short backfire antenna coupled to said waveguide.

9. An antenna for communicating left and right hand circularly polarized electromagnetic waves, comprising:

a cylindrical waveguide, said cylindrical waveguide includes: a closed end and an open end; an exterior and an interior; an orthomode transducer including first and second pins or ports longitudinally spaced apart and oriented orthogonally with respect to each other; said second pin extending radially within said waveguide and residing in proximity to said closed end of said cylindrical waveguide; said first pin extending radially within said waveguide and longitudinally spaced apart from said second pin and spaced distally with respect to said closed end of said cylindrical waveguide; a septum intermediate said first pin and said second pin; said septum aligned with said first pin and residing in proximity thereto; six radially oriented screws or posts extending from said exterior to said interior of said waveguide, said six radially oriented screws or posts residing between said first pin and said open end of said cylindrical waveguide;

said screws or posts enable maximized propagation and/or reception of said left hand circularly polarized electromagnetic waves by said first pin; and, said screws or posts enables maximized propagation and/or reception of said right hand circularly polarized electromagnetic waves by said second pin.

10. The antenna for communicating left and right hand circularly polarized electromagnetic waves as claimed in claim 9 wherein propagation of said circularly polarized electromagnetic waves results from linearly polarized excitation of said first and second pins and transformation of said linearly polarized waves by the impedance of said screws or posts into circularly polarized electromagnetic waves.

11. The antenna for communicating left and right hand circularly polarized electromagnetic waves as claimed in claim 9 wherein propagation of said circularly polarized electromagnetic waves results from linearly polarized excitation of said first and second pins and transformation of said linearly polarized waves by the impedance of said screws or posts and said septum into circularly polarized electromagnetic waves.

12. The antenna for communicating left and right hand circularly polarized electromagnetic waves as claimed in claim 9 wherein said reception of said circularly polarized electromagnetic waves is transformed by the impedance of said screws or posts into linearly polarized electromagnetic waves.

13. The antenna for communicating left and right hand circularly polarized electromagnetic waves as claimed in claim 9 wherein said reception of said circularly polarized electromagnetic waves is transformed by the impedance of said screws (or posts) and septum into linearly polarized electromagnetic waves.

14. The antenna for communicating left and right hand circularly polarized electromagnetic waves as claimed in claim 9 wherein said orthomode transducer includes a radially oriented screw or post residing in proximity to said second pin, and, said radially oriented screw fine tunes the performance of said second pin.

15. The antenna as claimed in claim 9, further comprising a short backfire antenna coupled to said waveguide.

16. The antenna for communicating left and right hand circularly polarized electromagnetic waves as claimed in claim 9, further comprising: a cup, said cup includes a frustum-conically shaped reflector base; a subreflector; said cup affixed to said open end of said waveguide; and, said subreflector separated apart from said reflector.

17. An antenna, comprising:

a cylindrical waveguide;

said cylindrical waveguide includes an open end and a closed end;

said cylindrical waveguide includes: a pair of longitudinally spaced orthogonal ports; each of said ports includes a pin extending into said waveguide; and, a polarizer;

a septum residing intermediate said pins and aligned with one of said pins;

said polarizer resides between one of said pins and said open end of said cylindrical waveguide;

said polarizer includes six radially oriented screws or posts extending therein; three of said six screws or posts are arranged 180° from the other three of said six radially oriented screws or posts; three of said screws or posts are arranged at an angle of 45° with respect to one of said pins; and, said other three screws or posts of said six radially oriented screws are arranged at an angle of 45° with respect to the other pin.

18. The antenna as claimed in claim 17, further comprising a short backfire antenna coupled to said waveguide.

19. The antenna as claimed in claim 17, further comprising: a radially oriented screw or post residing proximity to said second pin, and, said radially oriented screw fine tunes the performance of said second pin.

20. The antenna as claimed in claim 17, further comprising: a cup, said cup includes a frustum-conically shaped reflector base; a subreflector; said cup affixed to said open end of said waveguide; and, said subreflector separated apart from said reflector.

* * * * *